US009508280B2

(12) United States Patent
Seo et al.

(10) Patent No.: US 9,508,280 B2
(45) Date of Patent: Nov. 29, 2016

(54) METHOD OF COMPENSATING COLOR OF TRANSPARENT DISPLAY DEVICE

(71) Applicant: Samsung Display Co., Ltd., Yongin (KR)

(72) Inventors: Young-Jun Seo, Seoul (KR); Byung-Choon Yang, Seoul (KR); Chi-O Cho, Gwangju (KR)

(73) Assignee: Samsung Display Co., Ltd., Yongin-si (KR)

( * ) Notice: Subject to any disclaimer, the term of this patent is extended or adjusted under 35 U.S.C. 154(b) by 113 days.

(21) Appl. No.: 14/527,155

(22) Filed: Oct. 29, 2014

(65) Prior Publication Data

US 2015/0356902 A1 Dec. 10, 2015

(30) Foreign Application Priority Data

Jun. 5, 2014 (KR) ..... 10-2014-0068681

(51) Int. Cl.
*G09G 3/20* (2006.01)
*G09G 3/32* (2016.01)

(52) U.S. Cl.
CPC ..... *G09G 3/2003* (2013.01); *G09G 3/3208* (2013.01); *G09G 2320/0242* (2013.01); *G09G 2320/0666* (2013.01); *G09G 2340/06* (2013.01); *G09G 2360/144* (2013.01); *G09G 2360/145* (2013.01); *G09G 2360/16* (2013.01)

(58) Field of Classification Search
CPC .. G09G 5/02; G09G 5/06; G09G 2320/0666; G09G 2320/0626; G09G 3/2003; G06T 11/001
See application file for complete search history.

(56) References Cited

U.S. PATENT DOCUMENTS 7,184,067 B2 * 2/2007 Miller ..... G09G 3/3208 315/169.3
8,264,437 B2 * 9/2012 Nitanda ..... G09G 3/2003 345/102
2008/0002062 A1 1/2008 Kim et al.
2008/0211828 A1 9/2008 Huh et al.
2009/0027335 A1 * 1/2009 Ye ..... G06F 3/017 345/158
2009/0128530 A1 * 5/2009 Ek ..... G09G 5/00 345/207
2010/0320919 A1 * 12/2010 Gough ..... G09G 3/20 315/158
2011/0012866 A1 * 1/2011 Keam ..... G06F 3/0383 345/175
2012/0154711 A1 6/2012 Park et al.
2012/0268437 A1 10/2012 Lee
2013/0032694 A1 * 2/2013 Nakata ..... H04N 5/359 250/208.1
2013/0207948 A1 8/2013 Na et al.
2014/0063039 A1 * 3/2014 Drzaic ..... G09G 5/02 345/589

FOREIGN PATENT DOCUMENTS

JP 2012-247548 12/2012
KR 10-0647280 11/2006
KR 10-0763239 9/2007

(Continued)

*Primary Examiner* — Todd Buttram

(74) *Attorney, Agent, or Firm* — H.C. Park & Associates, PLC

(57) ABSTRACT

A method of compensating color of a transparent display device includes generating a first pixel data by adding an input image pixel data and an external optical data which represents an effect of an external light on the transparent display device, generating a second pixel data having the same color as the input image pixel data by scaling the first pixel data, and generating an output image pixel data by subtracting the external optical data from the second pixel data.

17 Claims, 24 Drawing Sheets

(56) References Cited

FOREIGN PATENT DOCUMENTS

| | | |
|---|---|---|
| KR | 10-2011-0137668 | 12/2011 |
| KR | 10-2012-0069363 | 6/2012 |
| KR | 10-2012-0119717 | 10/2012 |
| KR | 10-2013-0094095 | 8/2013 |

* cited by examiner

METHOD OF COMPENSATING COLOR OF TRANSPARENT DISPLAY DEVICE

CROSS-REFERENCE TO RELATED APPLICATION

This application claims priority from and the benefit of Korean Patent Application No. 10-2014-0068681, filed on Jun. 5, 2014, which is hereby incorporated by reference for all purposes as if fully set forth herein.

BACKGROUND

1. Field

Exemplary embodiments relate to a display device. More particularly, exemplary embodiments of the inventive concept relate to a method of compensating color of a transparent display device.

2. Discussion of the Background

A pixel of a transparent display device includes an emitting area and a transmissive window. The emitting areas of the pixels display an image. A viewer may see the background through the transmissive windows of the pixels.

In a general display device, because an external light cannot penetrate the display device, color of a displayed image may not be affected by the external light. In a transparent display device, however, color of a displayed image may be affected by the external light.

The above information disclosed in this Background section is only for enhancement of understanding of the background of the inventive concept, and, therefore, it may contain information that does not constitute prior art.

SUMMARY

Exemplary embodiments provide a method of compensating color of a transparent display device.

Additional aspects will be set forth in the detailed description which follows, and, in part, will be apparent from the disclosure, or may be learned by practice of the inventive concept.

According to some exemplary embodiments, a method of compensating color of a transparent display device includes generating a first pixel data by adding input image pixel data and external optical data which represents an effect of an external light on the transparent display device, generating second pixel data having the same color as the input image pixel data by scaling the first pixel data, and generating output image pixel data by subtracting the external optical data from the second pixel data.

According to some exemplary embodiments, a method of compensating color of a transparent display device includes generating a first pixel stimulus by adding an input image pixel stimulus and an external optical stimulus representing an effect of an external light on the transparent display device, generating a second pixel stimulus having the same color as the input image pixel stimulus by scaling the first pixel stimulus, and generating an output image pixel stimulus by subtracting the external optical stimulus from the second pixel stimulus.

A method of compensating color of a transparent display device may compensate an effect of an external light which is incident on the transparent display device, and may increase the recognition image quality of the viewer by increasing the luminance and maintaining the color.

In addition, the method of compensating color of the transparent display device may adjust the recognition image quality according to a background of the transparent display device. For a case of a wrist watch including the transparent display device, the color of the transparent display device included in the wrist watch may be compensated according to a skin color or a reflectivity of a skin.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain the principles of the inventive concept.

Illustrative, non-limiting exemplary embodiments will be more clearly understood from the following detailed description taken in conjunction with the accompanying drawings.

DETAILED DESCRIPTION OF THE ILLUSTRATED EMBODIMENTS

Figure 1:
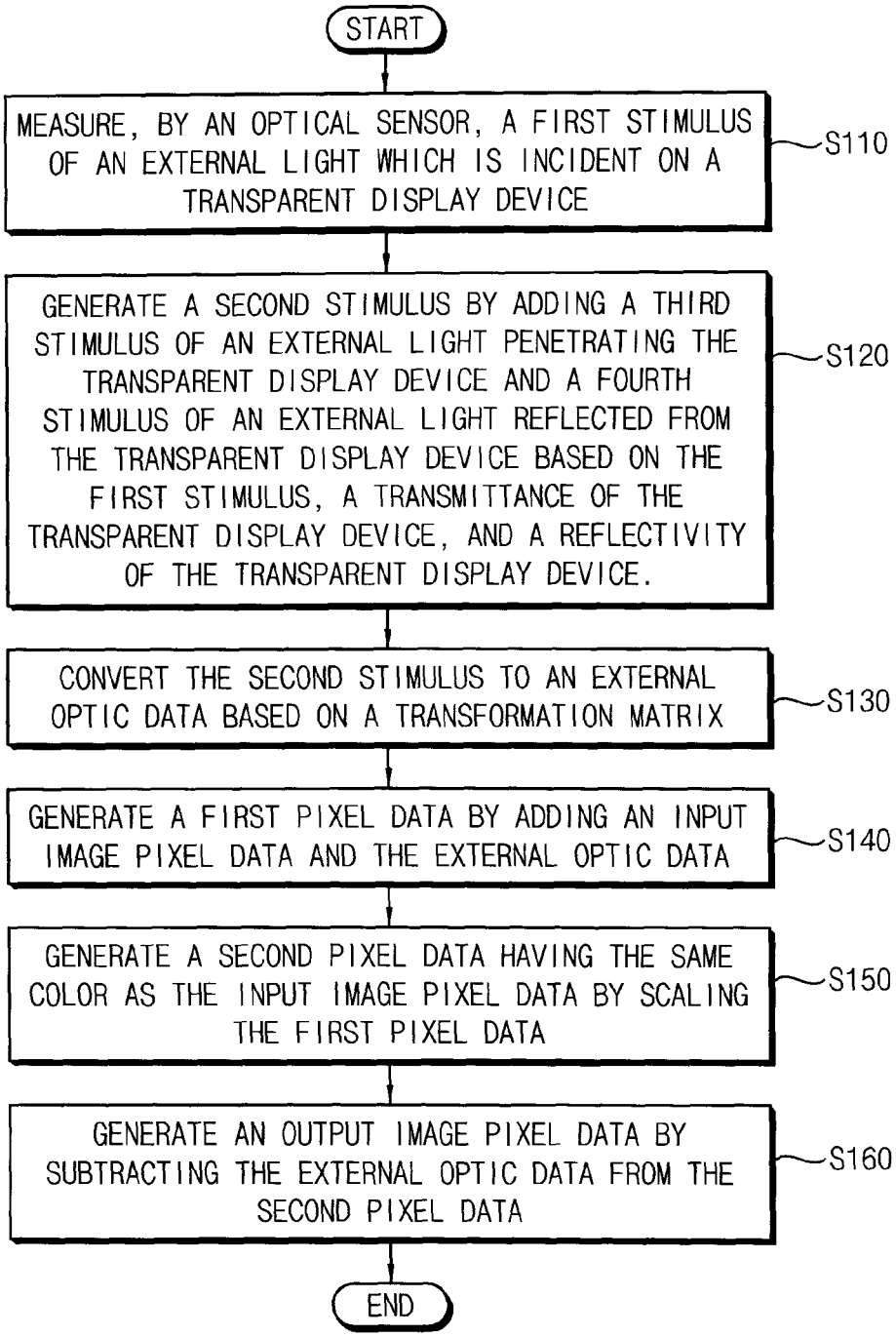
FIG. 1 is a flow chart illustrating a method of compensating color of a transparent display device according to exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a flow chart illustrating a method of compensating color of a transparent display device according to exemplary embodiments.

Referring to FIG. 1, a method of compensating color of a transparent display device includes generating first pixel data by adding input image pixel data and external optical data (S140). The external optical data represents an effect of an external light on the transparent display device. The method further includes generating second pixel data having the same color as the input image pixel data by scaling the first pixel data (S150). The method further includes generating output image pixel data by subtracting the external optical data from the second pixel data (S160).

The method may further include measuring, by an optical sensor, a first stimulus of the external light which is incident on the transparent display device (S110). The method may further include generating a second stimulus by adding a third stimulus of an external light penetrating the transparent display device and a fourth stimulus of an external light reflected from the transparent display device based on the first stimulus, a transmittance of the transparent display device, and a reflectivity of the transparent display device (S120). The method may further include converting the second stimulus to the external optical data based on a transformation matrix (S130).

Measuring, by the optical sensor, the first stimulus of the external light which is incident on the transparent display device (S110) will be described with the references to FIGS. 5B, 6B, 11, and 12. Generating the second stimulus (S120) will be described with the reference to FIG. 3.

Converting the second stimulus to the external optical data based on the transformation matrix (S130) may convert the second stimulus, including X, Y, and Z parameters as a tri-stimulus, to the external optical data, including R, G, and B data, based on the transformation matrix corresponding to a GOG (Gain, Offset, and Gamma) function. Because the transformation matrix is well-known to a person of ordinary skilled in the art, a description of the transformation matrix will be omitted. The transformation matrix may be implemented with a look-up table (LUT).

Generating the first pixel data by adding the input image pixel data and the external optical data (S140) will be described with the references to FIGS. 5C and 6C. Generating the second pixel data having the same color as the input image pixel data by scaling the first pixel data (S150) will be described with the references to FIGS. 5D and 6D.

Generating the output image pixel data by subtracting the external optical data from the second pixel data (S160) will be described with the references to FIGS. 5E and 6E.

Figure 2:
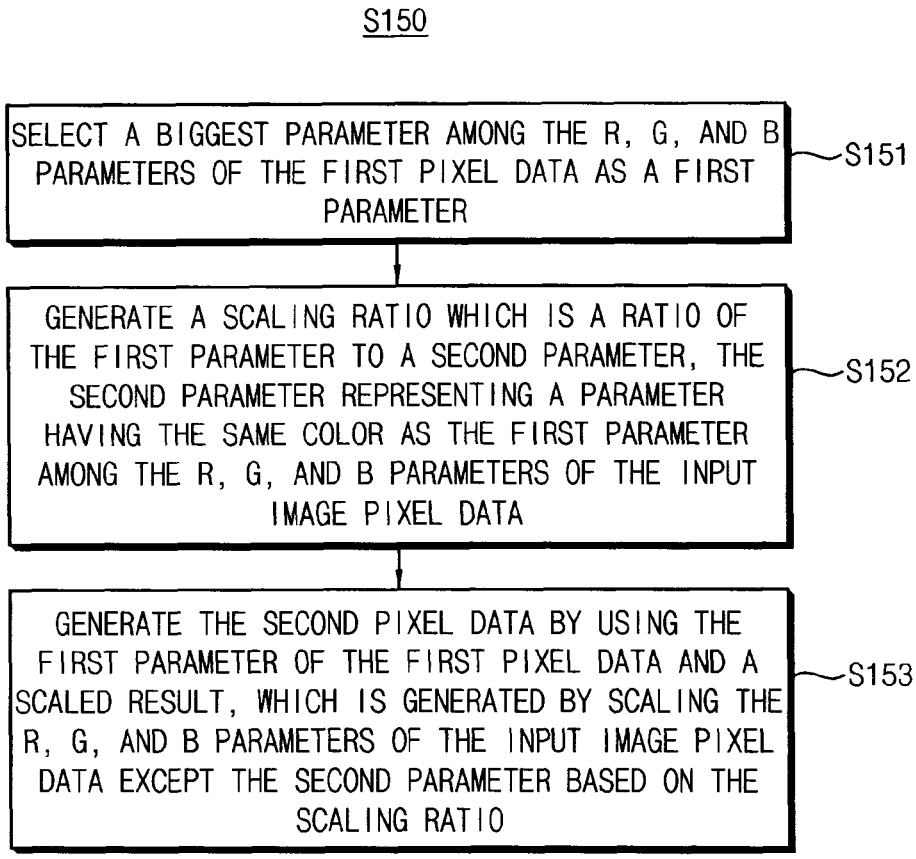
FIG. 2 is a flow chart illustrating generating the second pixel data having the same color as the input image pixel data by scaling the first pixel data included in the flow chart of FIG. 1 according to exemplary embodiments.

FIG. 2 is a flow chart illustrating generating the second pixel data having the same color as the input image pixel data by scaling the first pixel data included in the flow chart of FIG. 1 according to exemplary embodiments.

Referring to FIG. 2, generating the second pixel data having the same color as the input image pixel data by scaling the first pixel data (S150) may include selecting a biggest parameter among the R, G, and B parameters of the first pixel data as a first parameter (S151). Generating the second pixel data having the same color as the input image pixel data by scaling the first pixel data (S150) may include generating a scaling ratio which is a ratio of the first parameter to a second parameter (S152). The second parameter represents a parameter having the same color as the first parameter among the R, G, and B parameters of the input image pixel data. Generating the second pixel data having the same color as the input image pixel data by scaling the first pixel data (S150) may include generating the second pixel data by using the first parameter of the first pixel data and a scaled result, which is generated by scaling the R, G, and B parameters of the input image pixel data except the second parameter based on the scaling ratio (S153).

Selecting the biggest parameter (S151) and generating the scaling ratio (S152) will be described with the references to FIGS. 5C and 6C. Generating the second pixel data (S153) will be described with the reference to FIGS. 5D and 6D.

Figure 3:
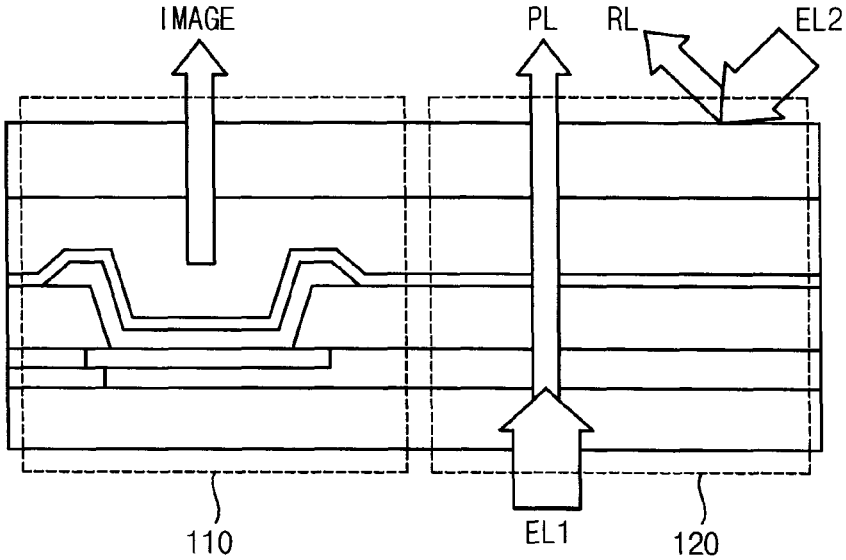
FIG. 3 is a sectional view illustrating the light generated from an OLED pixel included in a transparent display device according to exemplary embodiments.

FIG. 3 is a sectional view illustrating the light generated from an OLED pixel included in a transparent display device according to exemplary embodiments.

Referring to FIG. 3, an OLED pixel 100 of the transparent display device includes an emitting area 110 and a transmissive window 120. The emitting area 110 may output an image IMAGE corresponding to input image pixel data through a surface of the OLED pixel 100. A first external light EL1 is incident on an opposite surface of the OLED pixel 100, the opposite surface being opposite a surface through which the image IMAGE is output. A portion of the first external light EL1 which penetrates the OLED pixel 100 becomes a first light PL, i.e., the portion of the first external light EL1 travels through the OLED pixel 100 and is transmitted through the same surface through which the image IMAGE is output. The first external light EL1 may be light reflected off of a surface and/or may be light that has passed through the OLED pixel 100 or other portion of the device to be reflected off of the surface and reflected back through the OLED pixel 100. For example, the first external light EL1 may be light reflected off of the skin of a wearer of a device including the OLED pixel 100. A second external light EL2 is incident on the surface of the OLED pixel 100 through which the image IMAGE is output. A portion of the second external light EL2 which reflected from the OLED pixel 100 becomes a second light RL.

Because the image IMAGE is outputted from the OLED pixel 100 with the first light PL and the second light RL, a color of the image IMAGE may be changed according to the characteristics of the first external light EL1 and the second external light EL2 and the respective resultant first light PL and the second light RL.

Figure 4:
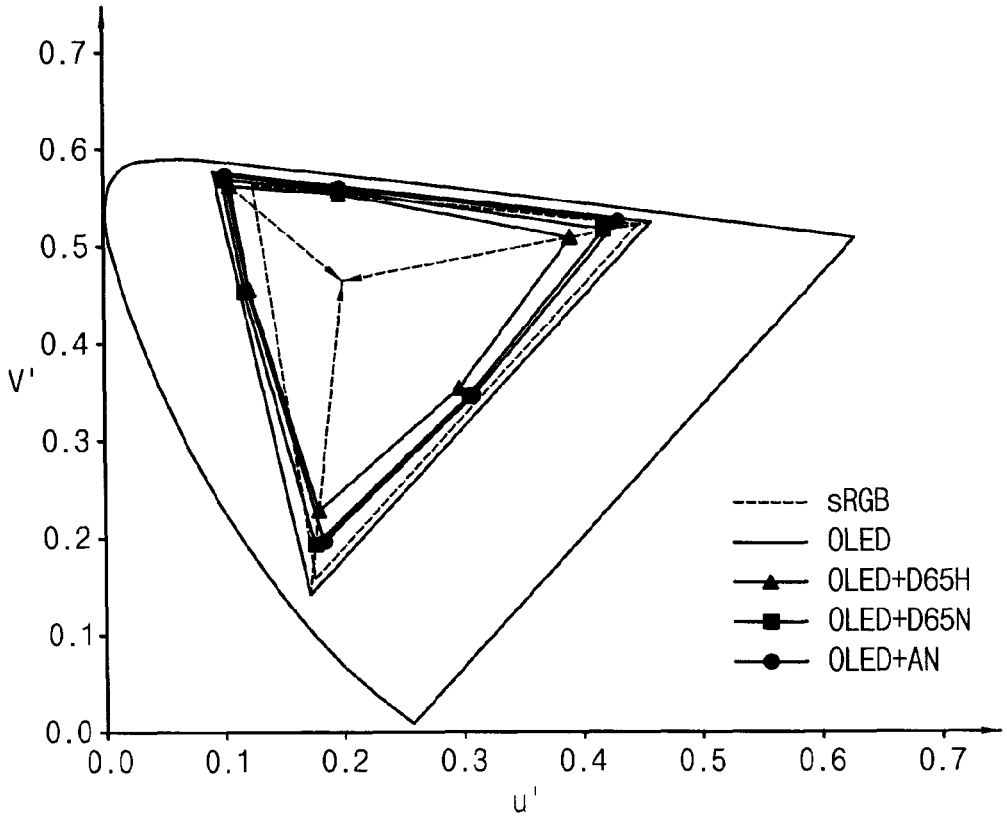
FIG. 4 is a graph illustrating color change by the external light on the transparent display device according to exemplary embodiments.

FIG. 4 is a graph illustrating color change by the external light on the transparent display device according to exemplary embodiments. FIG. 4 is a graph representing color coordinate according to CIE 1976.

Referring to FIG. 4, the outer most figure of FIG. 4 includes all colors. A triangle drawn with solid lines (OLED) (outer most solid triangle) describes a color boundary that an OLED display device can reproduce. Vertices of the triangle drawn with solid lines (OLED) represent red, green, and blue, respectively. The triangle drawn with solid lines (OLED) includes a white coordinate representing a white color.

A hexagon drawn with solid lines including circles (OLED+AN) describes a color boundary of an OLED display device when an incandescent light is incident on the transparent display device. Because the incandescent light and an image of the OLED display device are mixed, the purity of the image of the OLED display device may decrease. In a case that a white coordinate of the triangle drawn with solid lines (OLED) and a white coordinate of the incandescent light are different, a color of the OLED display device may be distorted.

A hexagon drawn with solid lines including rectangles (OLED+D65N) describes a color boundary of an OLED display device when a standard white light is incident on the transparent display device. Because the standard white light and an image of the OLED display device are mixed, the purity of the image of the OLED display device may decrease. In a case that a white coordinate of the triangle drawn with solid lines (OLED) and a white coordinate of the standard white light are different, a color of the OLED display device may be distorted.

A hexagon drawn with solid lines including triangles (OLED+D65H) describes a color boundary of an OLED display device when a sun light is incident on the transparent display device. Because the sun light and an image of the OLED display device are mixed, the purity of the image of the OLED display device may decrease. In a case that a white coordinate of the triangle drawn with solid lines (OLED) and a white coordinate of the sun light are different, a color of the OLED display device may be distorted.

Because a luminance of the sun light is bigger than a luminance of the incandescent light or a luminance of the standard white light in general, the hexagon drawn with solid lines including triangles (OLED+D65H) may be smaller than the hexagon drawn with solid lines including circles (OLED+AN) or the hexagon drawn with solid lines including rectangles (OLED+D65N). In other words, an OLED display device on which sun light is incident may reproduce fewer colors than an OLED display device on which the incandescent light or the standard white light is incident.

FIGS. 5A through 5E are graphs illustrating exemplary embodiments of data of the flow chart of FIG. 1. Each of the input image pixel data, the external optical data, the first pixel data, the second pixel data, and the output image pixel data includes an R (Red) parameter, a G (Green) parameter, and a B (Blue) parameter.

Figure 5A:
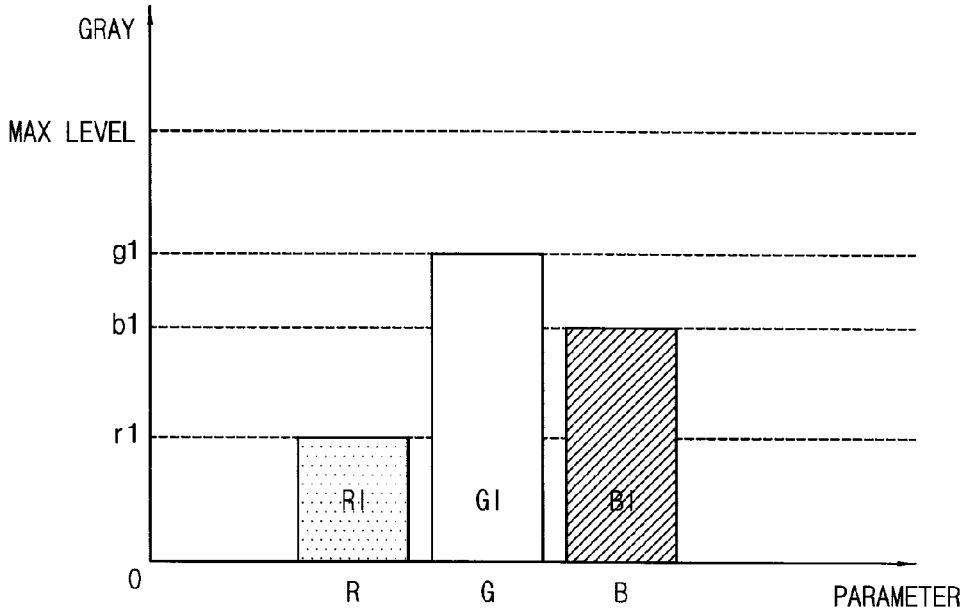
FIGS. 5A through 5E are graphs illustrating exemplary embodiments of data of the flow chart of FIG. 1.

Referring to FIG. 5A, the input image pixel data RI, GI, and BI includes r1 as the R parameter, includes g1 as the G parameter, and includes b1 as the B parameter.

Figure 5B:
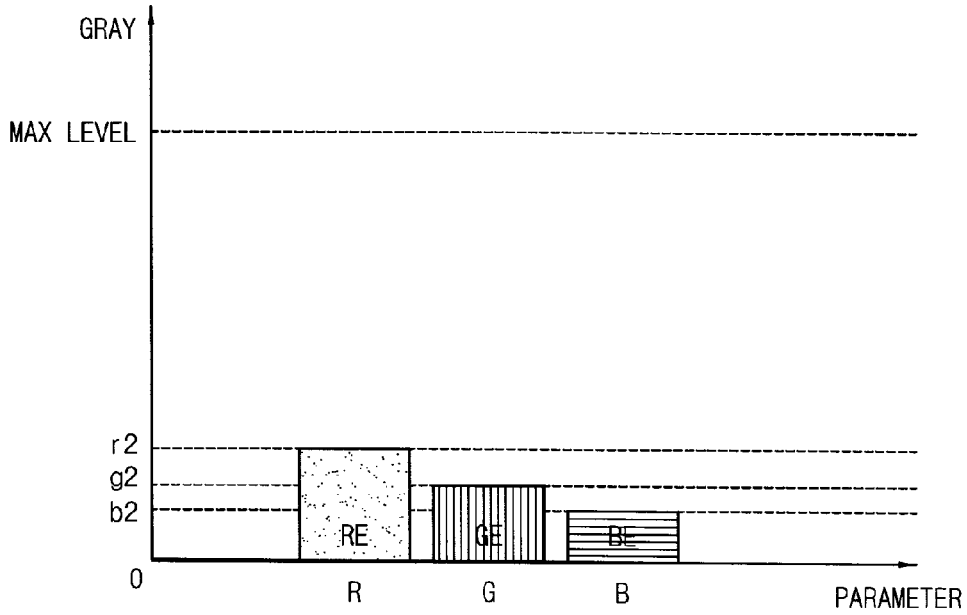

Referring to FIG. 5B, the external optical data RE, GE, and BE includes r2 as the R parameter, includes g2 as the G parameter, and includes b2 as the B parameter. The external optical data RE, GE, and BE may be calculated based on a stimulus measured by optical sensor 270 included in the transparent display device 200 of FIG. 11. The external optical data RE, GE, and BE may be calculated based on a stimulus measured by first optical sensor 371 or second optical sensor 372 included in the transparent display device 300 of FIG. 12.

Figure 5C:
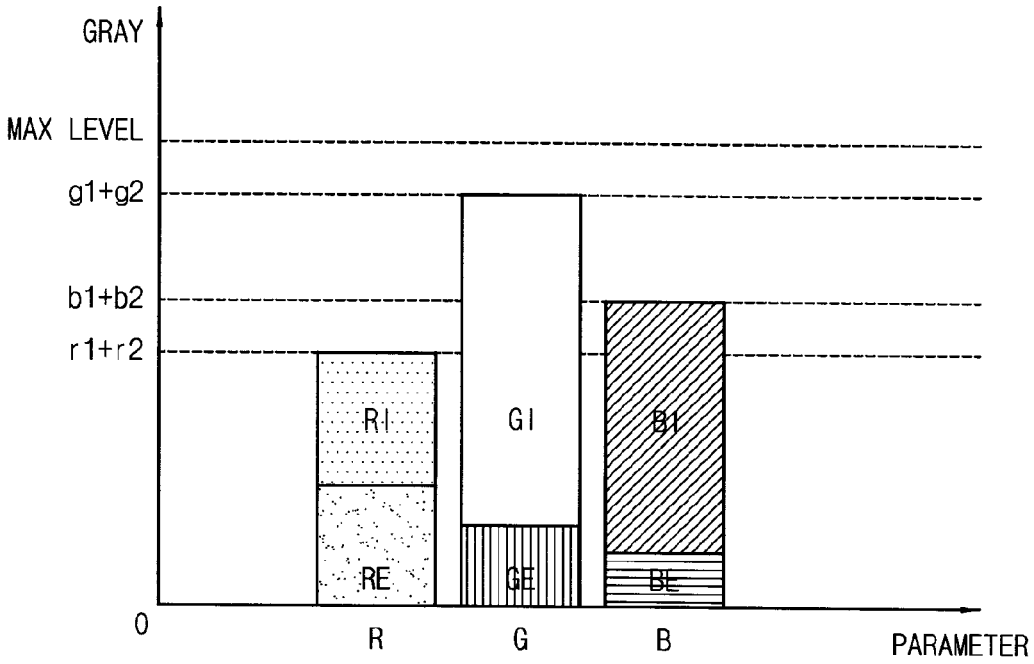

Referring to FIG. 5C, generating the first pixel data by adding the input image pixel data and the external optical data (S140 of FIG. 1) may calculate r1+r2 as the R parameter of the first pixel data by adding r1, the R parameter of the input image pixel data RI, GI, and BI, and r2, the R parameter of the external optical data RE, GE, and BE. Generating the first pixel data by adding the input image pixel data and the external optical data (S140) may calculate g1+g2 as the G parameter of the first pixel data by adding g1, the G parameter of the input image pixel data RI, GI, and BI, and g2, the G parameter of the external optical data RE, GE, and BE. Generating the first pixel data by adding the input image pixel data and the external optical data (S140) may calculate b1+b2 as the B parameter of the first pixel data by adding b1, the B parameter of the input image pixel data RI, GI, and BI, and b2, the B parameter of the external optical data RE, GE, and BE.

Selecting the biggest parameter among the R, G, and B parameters of the first pixel data as the first parameter (S151 of FIG. 2) may select the G parameter of the first pixel data, which has the biggest value, for example, (g1+g2) among the R, G, and B parameters of the first pixel data as shown in FIG. 5C, as the first parameter.

Generating the scaling ratio (S152 of FIG. 2) may set the scaling ratio as the ratio of the first parameter to the second parameter, which is, in this example, (g1+g2)/g1, in which g1+g2 is the first parameter and the G parameter of the first pixel data, and g1 is the second parameter and the G parameter of the input image pixel data RI, GI, and BI.

Generating the scaling ratio (S152) may include generating the scaling ratio having a ratio of the first parameter to a limit value of the second parameter when the second parameter has a value equal to the limit value of the second parameter. In FIG. 5C, when the G parameter of the input image pixel data RI, GI, and BI (i.e., the second parameter) has a value equal to the limit value MAX LEVEL of the G parameter of the input image pixel data RI, GI, and BI, the scaling ratio may be (MAX LEVEL+g2)/MAX LEVEL, which is a ratio of MAX LEVEL+g2, the G parameter of the first pixel data, to MAX LEVEL, the limit value of the G parameter of the input image pixel data RI, GI, and BI.

Figure 5D:
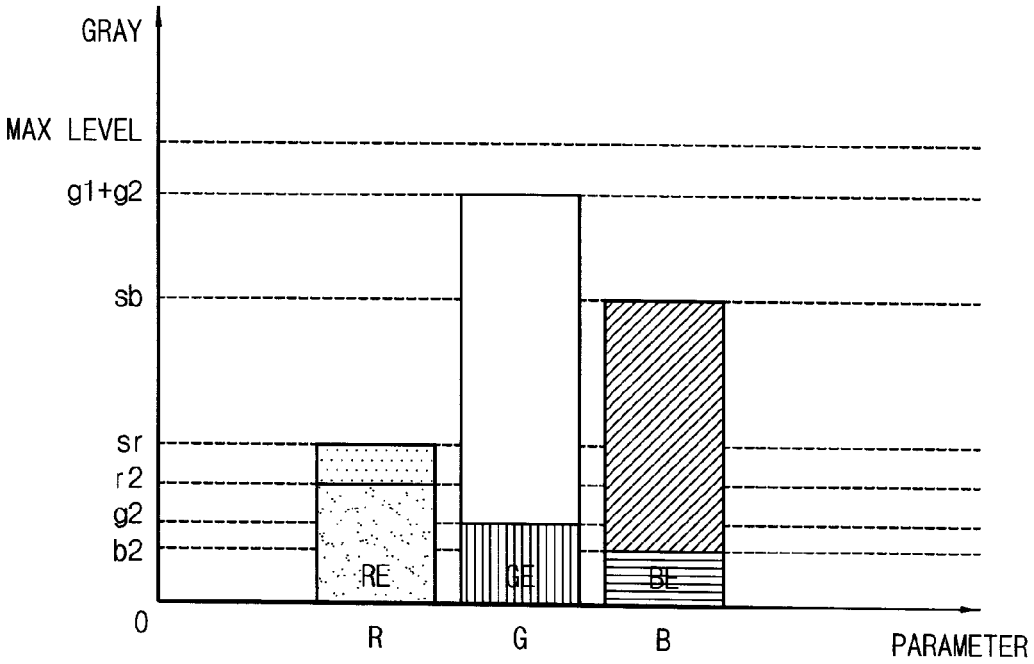

Referring to FIG. 5D, generating the second pixel data by using the first parameter of the first pixel data and the scaled result (S153 of FIG. 2) may set the R parameter of the second pixel data as sr (=r1*(g1+g2)/g1 or r1*(MAX LEVEL+g2)/MAX LEVEL) by scaling the R parameter of the input image pixel data RI, GI, and BI based on the scaling ratio. Generating the second pixel data by using the first parameter of the first pixel data and the scaled result (S153) may set the G parameter of the second pixel data as g1+g2, the G parameter of the first pixel data. Generating the second pixel data by using the first parameter of the first pixel data and the scaled result (S153) may set the B parameter of the second pixel data as sb (=b1*(g1+g2)/g1 or b1*(MAX LEVEL+g2)/MAX LEVEL) by scaling the B parameter of the input image pixel data RI, GI, and BI based on the scaling ratio.

Because a ratio of the R, G, and B parameters of the second pixel data is the same as a ratio of the R, G, and B parameters of the input image pixel data RI, GI, and BI, the second pixel data and the input image pixel data RI, GI, and BI have the same color. Because the R, G, and B parameters of the second pixel data are bigger than the R, G, and B parameters of the input image pixel data RI, GI, and BI respectively, a luminance of the second pixel data is bigger than a luminance of the input image pixel data RI, GI, and BI.

Figure 5E:
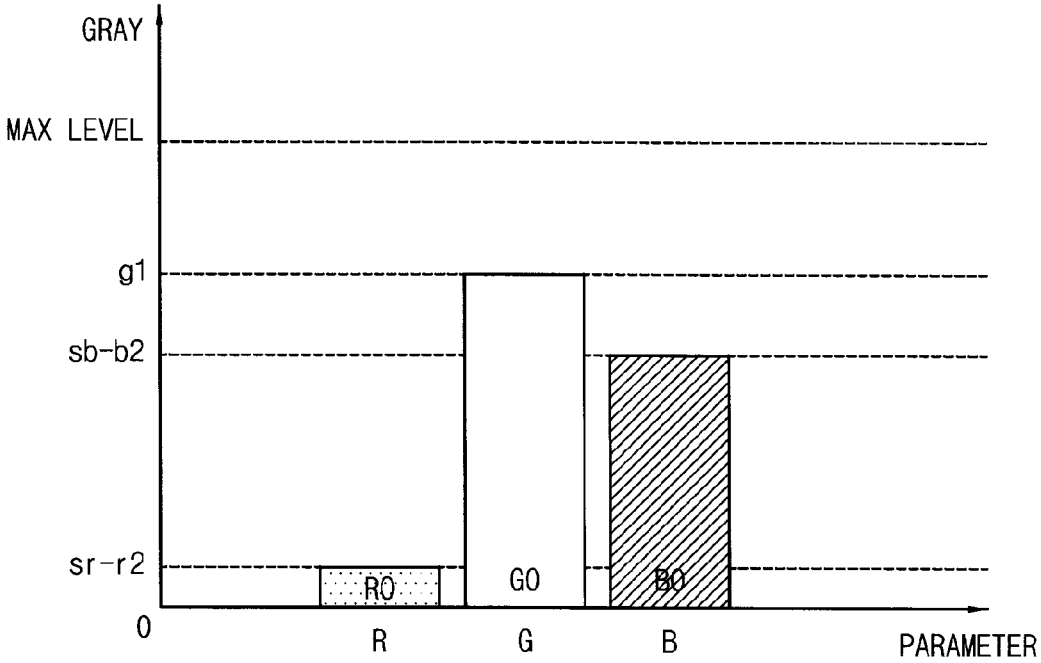

Referring to FIG. 5E, generating the output image pixel data by subtracting the external optical data from the second pixel data (S160 of FIG. 1) may calculate sr-r2 as RO, the R parameter of the output image pixel data, by subtracting r2, the R parameter of the external optical data RE, GE, and BE, from sr, the R parameter of the second pixel data. Generating the output image pixel data by subtracting the external optical data from the second pixel data (S160) may calculate g1 as GO, the G parameter of the output image pixel data, by subtracting g2, the G parameter of the external optical data RE, GE, and BE, from g1+g2, the G parameter of the second pixel data. Generating the output image pixel data by subtracting the external optical data from the second pixel data (S160) may calculate sb−b2 as BO, the B parameter of the output image pixel data, by subtracting b2, the B parameter of the external optical data RE, GE, and BE, from sb, the B parameter of the second pixel data.

When pixels included in the transparent display device are driven by the output image pixel data, a viewer of the transparent display device may see the second pixel data, generated by adding the output image pixel data and the external optical data. In this case, because a color of the second pixel data is the same as a color of the input image pixel data RI, GI, and BI and a luminance of the second pixel data is bigger than a luminance of the input image pixel data RI, GI, and BI, the transparent display device may output more clear image without color distortion.

FIG. 6A through 6H are graphs illustrating exemplary embodiments of data of the flow chart of FIG. 1 according to exemplary embodiments.

Figure 6A:
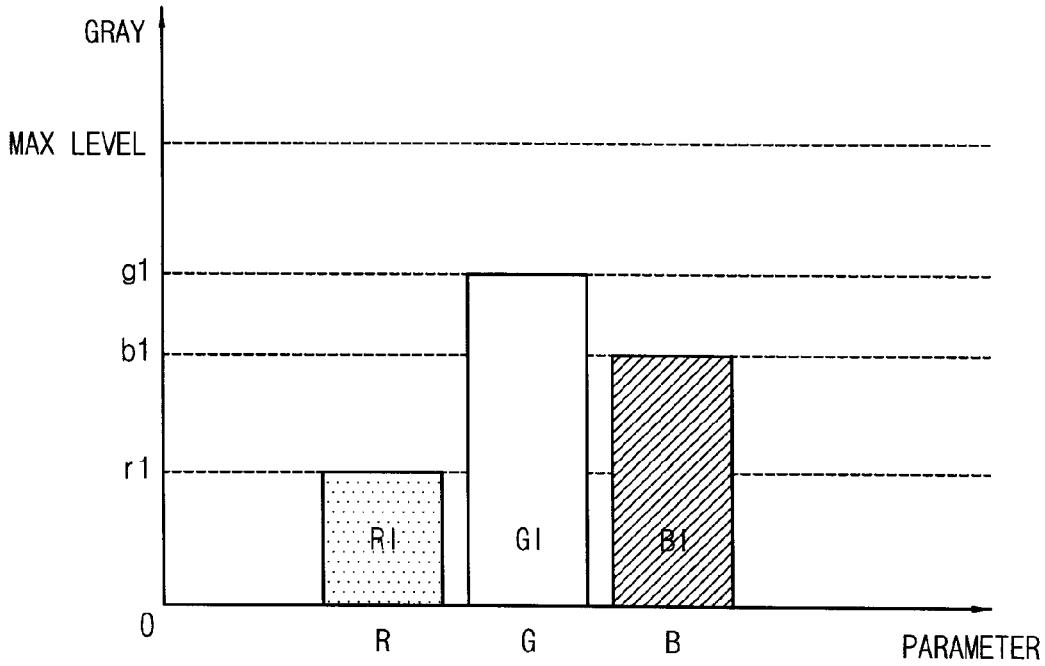
FIG. 6A through 6H are graphs illustrating exemplary embodiments of data of the flow chart of FIG. 1.

Referring to FIG. 6A, the input image pixel data RI, GI, and BI includes r1 as the R parameter, includes g1 as the G parameter, and includes b1 as the B parameter.

Figure 6B:
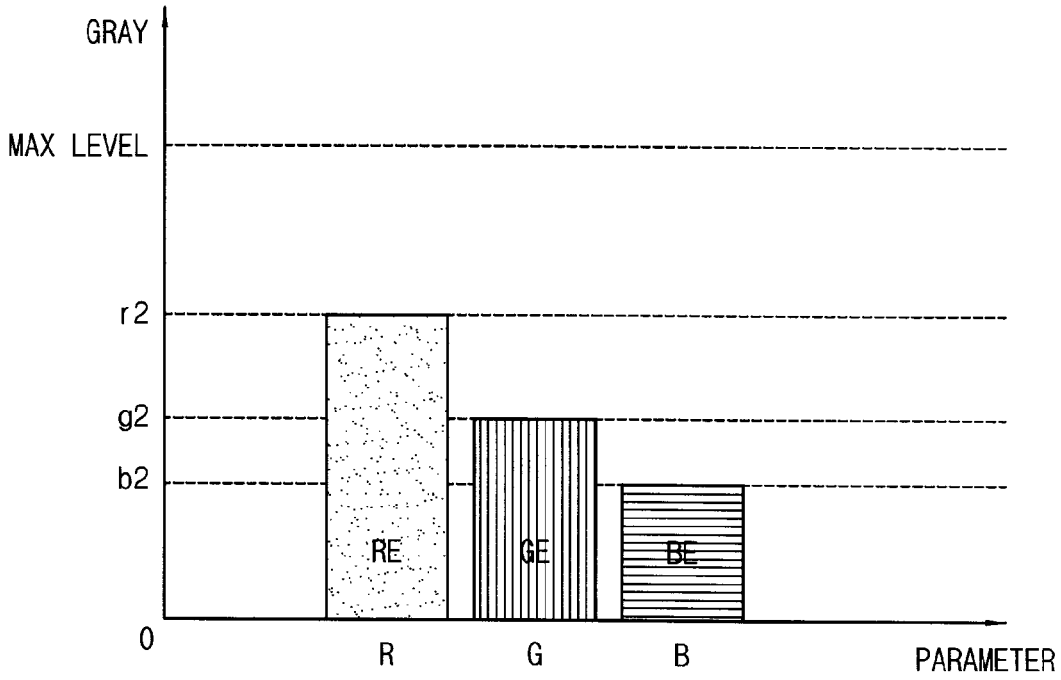

Referring to FIG. 6B, the external optical data RE, GE, and BE includes r2 as the R parameter, includes g2 as the G parameter, and includes b2 as the B parameter. A luminance of the external optical data RE, GE, and BE of FIG. 6B may be bigger than a luminance of the external optical data RE, GE, and BE of FIG. 5B. The external optical data RE, GE, and BE may be calculated based on a stimulus measured by optical sensor 270 included in the transparent display device 200 of FIG. 11. The external optical data RE, GE, and BE may be calculated based a stimulus measured by first optical sensor 371 or second optical sensor 372 included in the transparent display device 300 of FIG. 12.

Figure 6C:
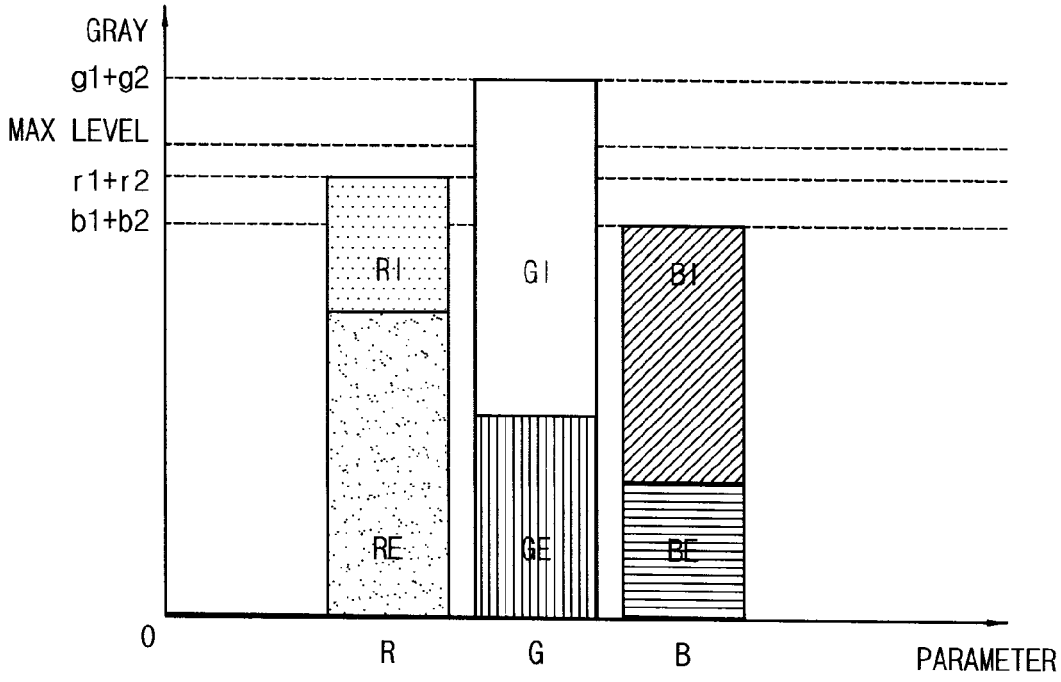

Referring to FIG. 6C, generating the first pixel data by adding the input image pixel data and the external optical data (S140 of FIG. 1) may calculate r1+r2 as the R parameter of the first pixel data by adding r1, the R parameter of the input image pixel data RI, GI, and BI, and r2, the R parameter of the external optical data RE, GE, and BE. Generating the first pixel data by adding the input image pixel data and the external optical data (S140) may calculate g1+g2 as the G parameter of the first pixel data by adding g1, the G parameter of the input image pixel data RI, GI, and BI, and g2, the G parameter of the external optical data RE, GE, and BE. Generating the first pixel data by adding the input image pixel data and the external optical data (S140) may calculate b1+b2 as the B parameter of the first pixel data by adding b1, the B parameter of the input image pixel data RI, GI, and BI, and b2, the B parameter of the external optical data RE, GE, and BE.

Selecting the biggest parameter among the R, G, and B parameters of the first pixel data as the first parameter (S151 of FIG. 2) may select the G parameter of the first pixel data, which has the biggest value (g1+g2) among the R, G, and B parameters of the first pixel data, as the first parameter.

Generating the scaling ratio (S152 of FIG. 2) may set the scaling ratio as the ratio of the first parameter to the second parameter, which is, in this example, (g1+g2)/g1, in which g1+g2 is the first parameter and the G parameter of the first pixel data, and g1 is the second parameter and the G parameter of the input image pixel data RI, GI, and BI.

When the G parameter of the input image pixel data RI, GI, and BI (the second parameter) has a value equal to the limit value MAX LEVEL of the G parameter of the input image pixel data RI, GI, and BI, generating the scaling ratio (S152 of FIG. 2) may set the scaling ratio as (MAX LEVEL+g2)/MAX LEVEL, which is a ratio of MAX LEVEL+g2, the G parameter of the first pixel data, to MAX LEVEL, the limit value of the G parameter of the input image pixel data RI, GI, and BI.

Figure 6D:
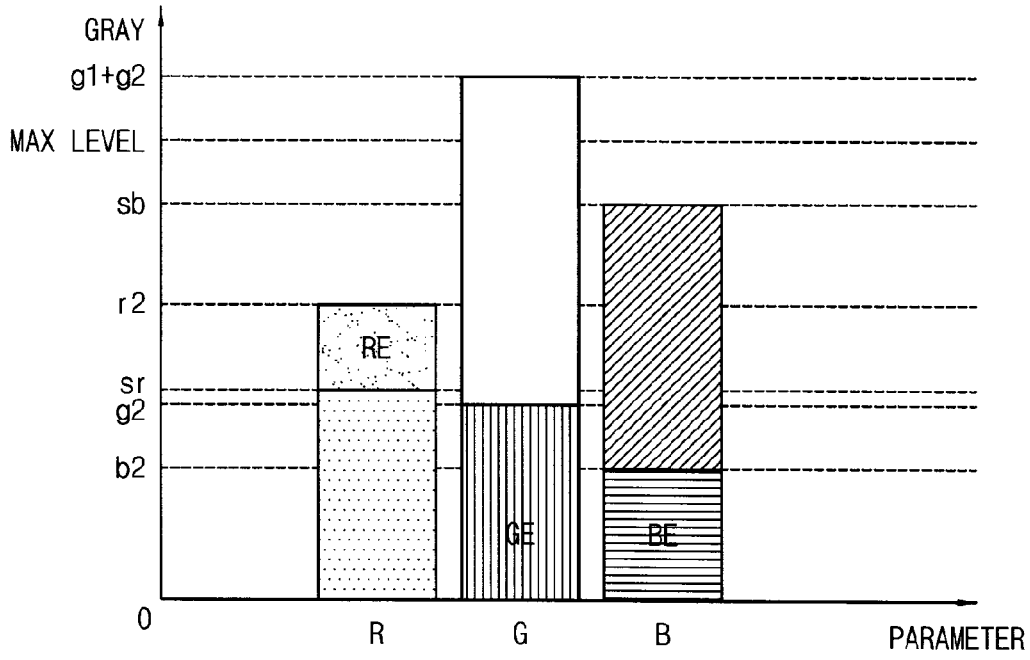

Referring to FIG. 6D, generating the second pixel data by using the first parameter of the first pixel data and the scaled result (S153 of FIG. 2) may set the R parameter of the second pixel data as sr (=r1*(g1+g2)/g1 or r1*(MAX LEVEL+g2)/MAX LEVEL) by scaling the R parameter of the input image pixel data RI, GI, and BI based on the scaling ratio. As shown in FIG. 6D, the scaled second pixel data sr for the R parameter is less than the R parameter of the external optical data RE, GE, and BE. Generating the second pixel data by using the first parameter of the first pixel data and the scaled result (S153) may set the G parameter of the second pixel data as g1+g2, the G parameter of the first pixel data. Generating the second pixel data by using the first parameter of the first pixel data and the scaled result (S153) may set the B parameter of the second pixel data as sb (=b1*(g1+g2)/g1 or b1*(MAX LEVEL+g2)/MAX LEVEL) by scaling the B parameter of the input image pixel data RI, GI, and BI based on the scaling ratio.

Because a ratio of the R, G, and B parameters of the second pixel data is the same as a ratio of the R, G, and B parameters of the input image pixel data RI, GI, and BI, the second pixel data and the input image pixel data RI, GI, and BI have the same color. Because the R, G, and B parameters of the second pixel data are bigger than the R, G, and B parameters of the input image pixel data RI, GI, and BI respectively, a luminance of the second pixel data is bigger than a luminance of the input image pixel data RI, GI, and BI.

Figure 6E:
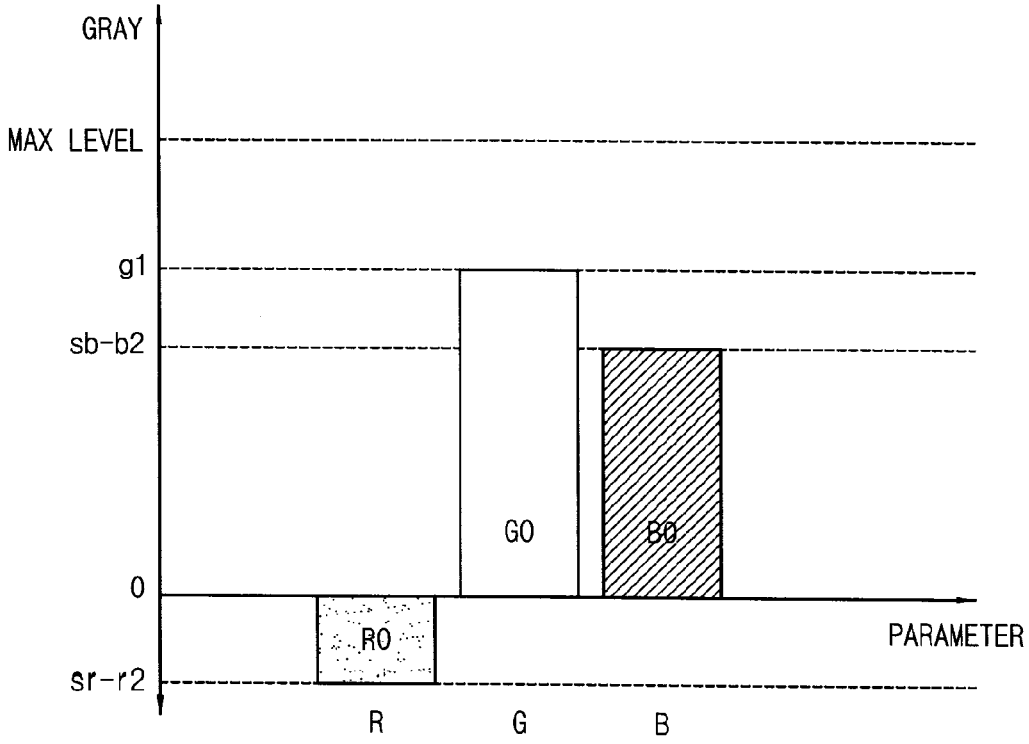

Referring to FIG. 6E, generating the output image pixel data by subtracting the external optical data from the second pixel data (S160 of FIG. 1) may calculate sr-r2 as RO, the R parameter of the output image pixel data, by subtracting r2, the R parameter of the external optical data RE, GE, and BE, from sr, the R parameter of the second pixel data. Generating the output image pixel data by subtracting the external optical data from the second pixel data (S160) may calculate g1 as GO, the G parameter of the output image pixel data, by subtracting g2, the G parameter of the external optical data RE, GE, and BE, from g1+g2, the G parameter of the second pixel data. Generating the output image pixel data by subtracting the external optical data from the second pixel data (S160) may calculate sb-b2 as BO, the B parameter of the output image pixel data, by subtracting b2, the B parameter of the external optical data RE, GE, and BE, from sb, the B parameter of the second pixel data.

According to exemplary embodiments, generating the output image pixel data by subtracting the external optical data from the second pixel data (S160 in FIG. 1) may include a generating the output image pixel data to be the same as the input image pixel data when at least one parameter among the R, G, and B parameters of the output image pixel data has a negative value. In FIG. 6E, the R parameter of the second pixel data has a negative value, sr-r2. In this case, the output image pixel data may be compensated to be the input image pixel data RI, GI, and BI.

According to exemplary embodiments, generating the output image pixel data by subtracting the external optical data from the second pixel data (S160 in FIG. 1) may include a compensating the output image pixel data by an inverse and add method when at least one parameter among the R, G, and B parameters of the output image pixel data has a negative value. The inverse and add method scales the parameters of the output image pixel that the at least one parameter has 0 and the color of the output image pixel data is maintained. Compensating the output image pixel data by the inverse and add method will be described with the references to FIGS. 6F through 6H.

Figure 6F:
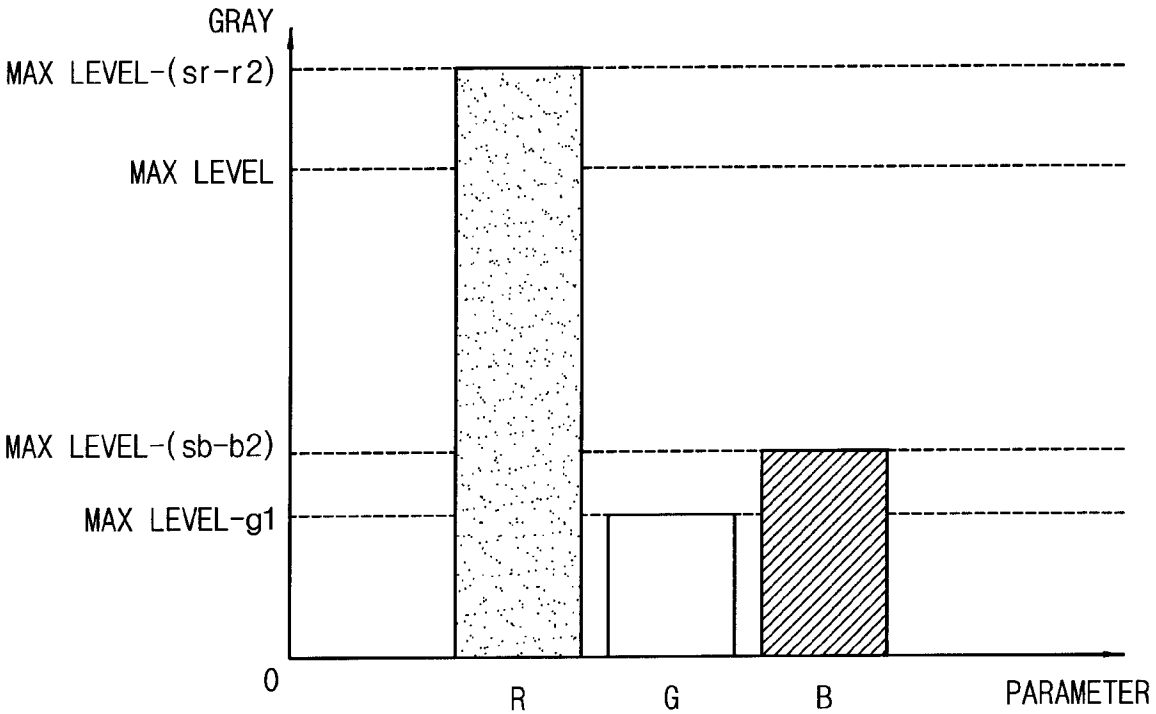

FIG. 6F illustrates a case that the R parameter of the output image pixel data has a negative value. First output image pixel data is generated by subtracting the parameters of the output image pixel data as shown in FIG. 6E from the limit value MAX LEVEL of the parameters of the output image pixel data. The first output image pixel data has MAX LEVEL−(sr−r2) as the R parameter, MAX LEVEL−g1 as the G parameter, and MAX LEVEL−(sb−b2) as the B parameter. D (=MAX LEVEL/(MAX LEVEL−(sr−r2))) is a ratio of MAX LEVEL, the limit value of the parameters of the first output image pixel data, to MAX LEVEL−(sr−r2), the R parameter which has a largest value among the R, G, and B parameters of the first output image pixel data. Here, the R parameter is selected or determined as having the largest value among the R, G, and B parameters of the first output image pixel data; however, aspects need not be limited thereto such that the G and B parameters may be selected or determined according circumstances.

Figure 6G:
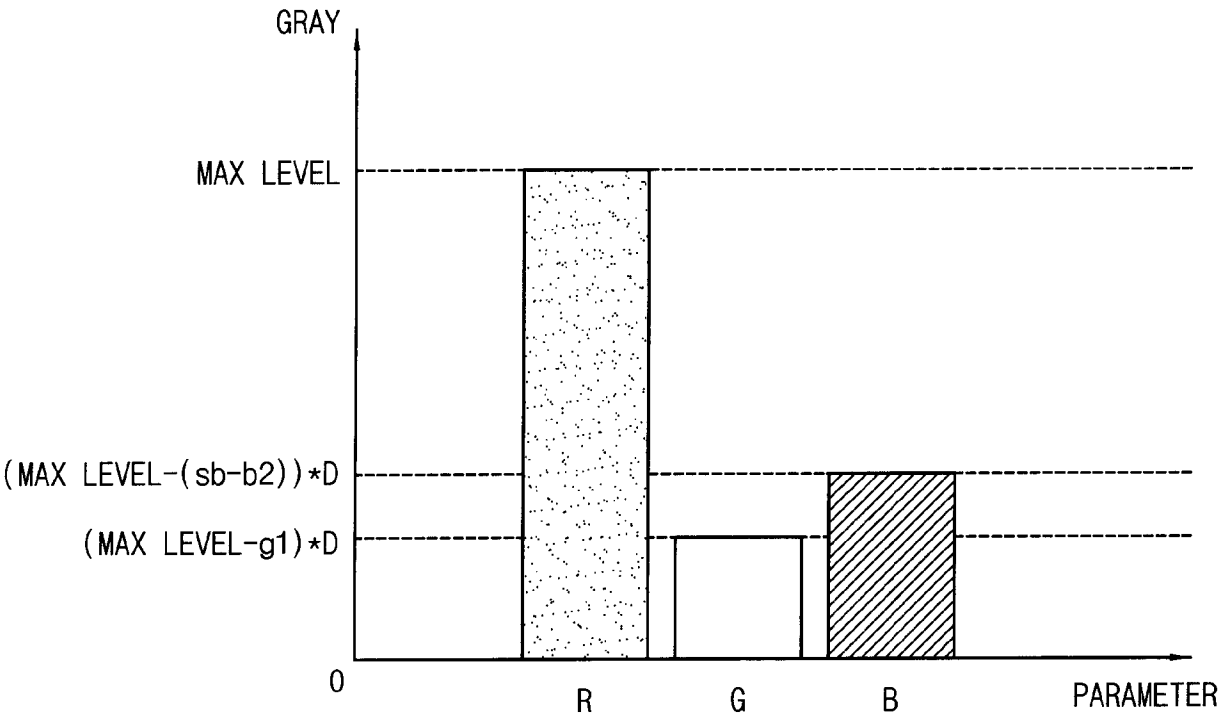

Referring to FIG. 6G, a second output image pixel data is generated by scaling the first output image pixel data based on the D. The second output image pixel data has MAX LEVEL as the R parameter, (MAX LEVEL−g1)*D as the G parameter, and (MAX LEVEL−(sb−b2))*D as the B parameter.

Figure 6H:
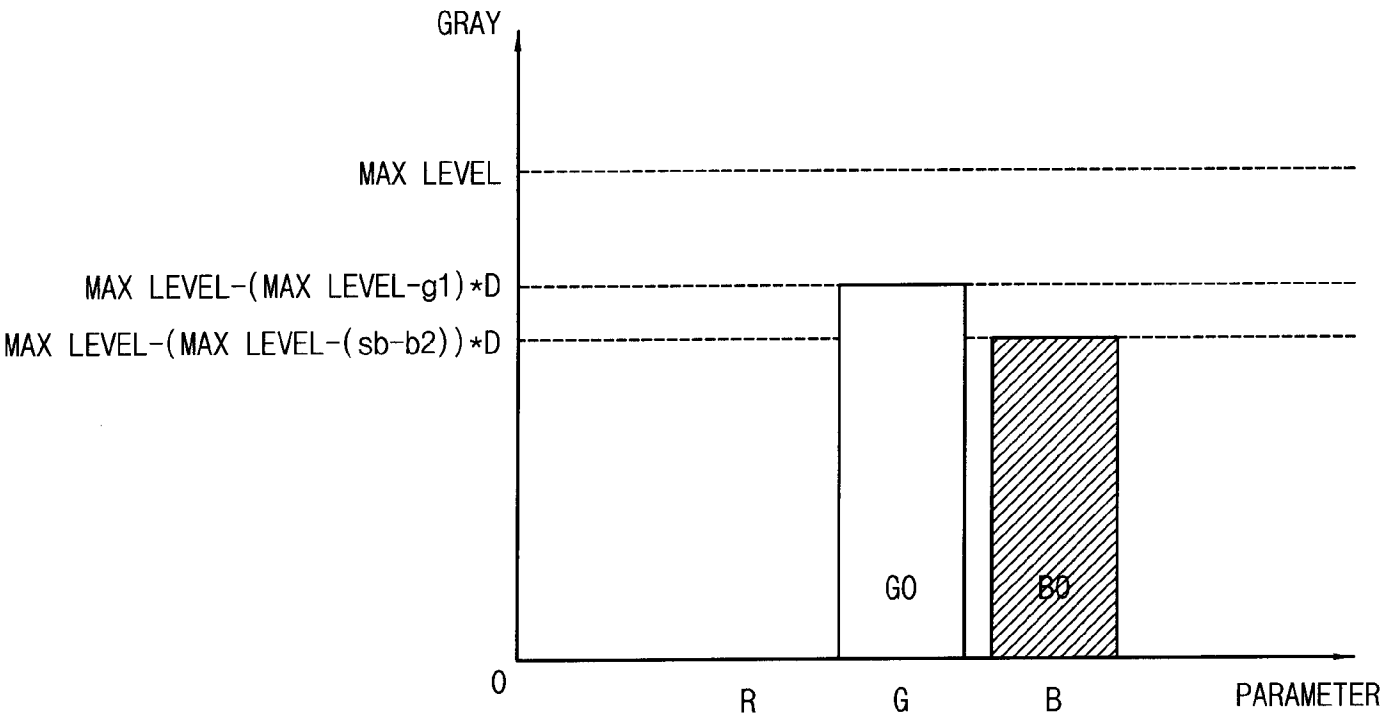

Referring to FIG. 6H, a third output image pixel data is generated by subtracting the second output image pixel data from the limit value MAX LEVEL of the parameters of the second output image pixel data. The third output image pixel data has a value of 0 as the R parameter, MAX LEVEL−(MAX LEVEL−g1)*D as the G parameter, and MAX LEVEL−(MAX LEVEL−(sb−b2))*D as the B parameter.

Generating the output image pixel data by subtracting the external optical data from the second pixel data (S160) may generate the output image pixel data which has the third output image pixel data.

Figure 7:
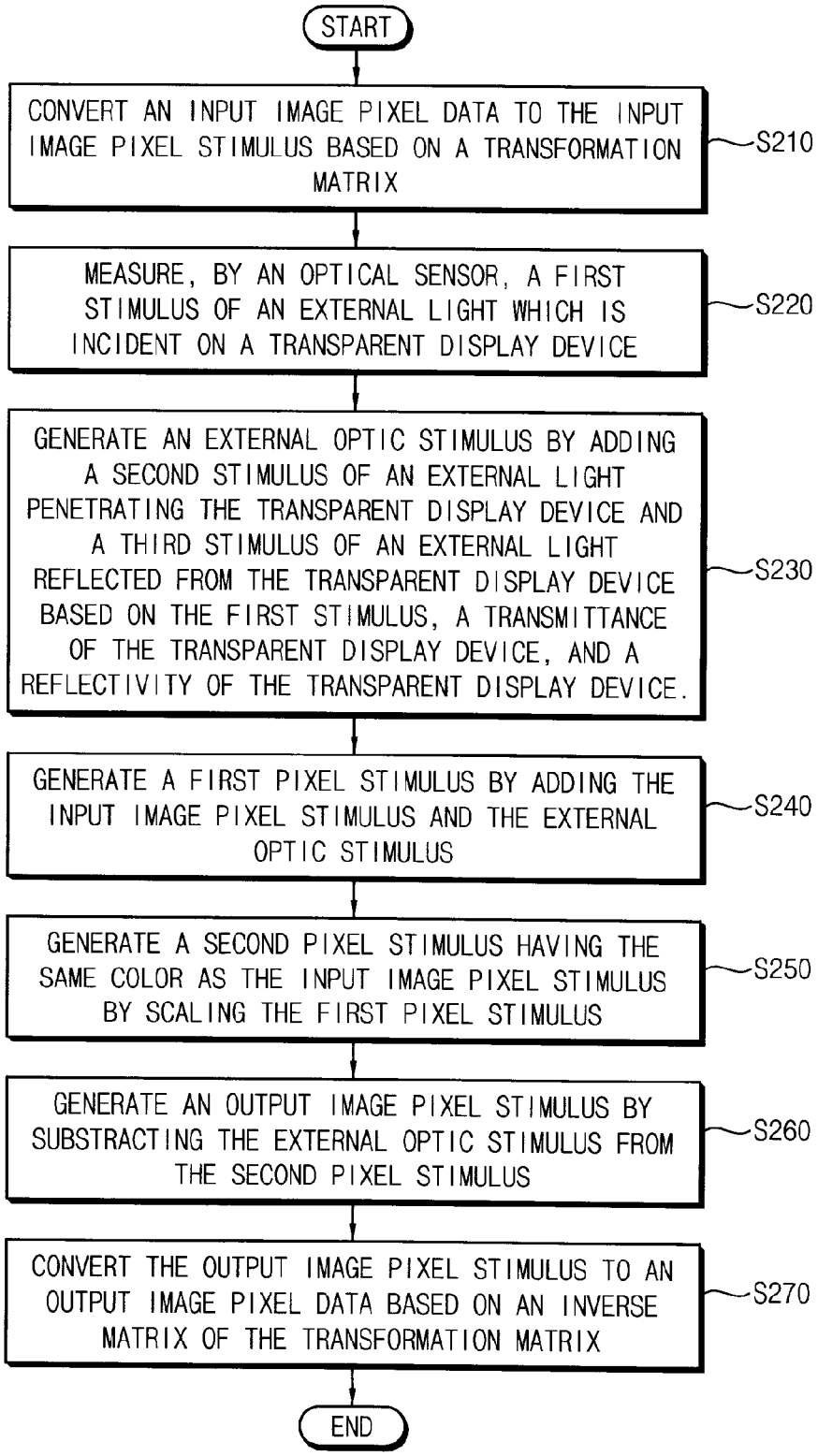
FIG. 7 is a flow chart illustrating a method of compensating color of a transparent display device according to exemplary embodiments.

FIG. 7 is a flow chart illustrating a method of compensating color of a transparent display device according to exemplary embodiments.

Referring to FIG. 7, a method of compensating color of a transparent display device includes a generating a first pixel stimulus by adding an input image pixel stimulus and an external optical stimulus representing an effect of an external light on the transparent display device (S240). The method includes generating a second pixel stimulus having the same color as the input image pixel stimulus by scaling the first pixel stimulus (S250). The method includes generating an output image pixel stimulus by subtracting the external optical stimulus from the second pixel stimulus (S260).

The method may further include converting an input image pixel data to the input image pixel stimulus based on a transformation matrix (S210). The method may further include measuring, by an optical sensor, a first stimulus of the external light which is incident on the transparent display device (S220). The method may further include generating the external optical stimulus by adding a second stimulus of an external light penetrating the transparent display device and a third stimulus of an external light reflected from the transparent display device based on the first stimulus, a transmittance of the transparent display device, and a reflectivity of the transparent display device (S230).

The method may further include converting the output image pixel stimulus to output image pixel data based on an inverse matrix of the transformation matrix (S270).

Converting the input image pixel data to the input image pixel stimulus based on the transformation matrix (S210) may convert the input image pixel data including R, G, and B data to the input image pixel stimulus including X, Y, and Z parameters as a tri-stimulus, based on the transformation matrix corresponding to a GOG (Gain, Offset, and Gamma) function. Because the transformation matrix is well-known to a person of ordinary skilled in the art, a description of the transformation matrix will be omitted. The transformation matrix may be implemented with a look-up table (LUT).

Measuring, by the optical sensor, the first stimulus of the external light which is incident on the transparent display device (S220) may be understood based on at least references to FIGS. 9B, 10B, 11, and 12 and will be described with reference thereto. Generating the external optical stimulus (S230) may be understood based on at least reference to FIG. 3.

Generating the first pixel stimulus by adding the input image pixel stimulus and the external optical stimulus (S240) may be understood based on at least references to FIGS. 9C and 10C and will be described with reference thereto. Generating the second pixel stimulus having the same color as the input image pixel stimulus by scaling the first pixel stimulus (S250) may be understood based on at least references to FIGS. 9D and 10D and will be described with reference thereto. Generating the output image pixel stimulus by subtracting the external optical stimulus from the second pixel stimulus (S260) may be under stood based on at least references to FIGS. 9E and 10E and will be described with reference thereto.

Converting the output image pixel stimulus to the output image pixel data based on the inverse matrix of the transformation matrix (S270) may be understood based on at least converting the input image pixel data to the input image pixel stimulus based on the transformation matrix (S210). For example, the converting the output image pixel stimulus to the output image pixel data (S270) may convert the output image pixel stimulus, including X, Y, and Z parameters as a tri-stimulus, to the output image pixel data, including R, G, and B data, based on an inverse of the transformation matrix corresponding to a GOG (Gain, Offset, and Gamma) function.

Figure 8:
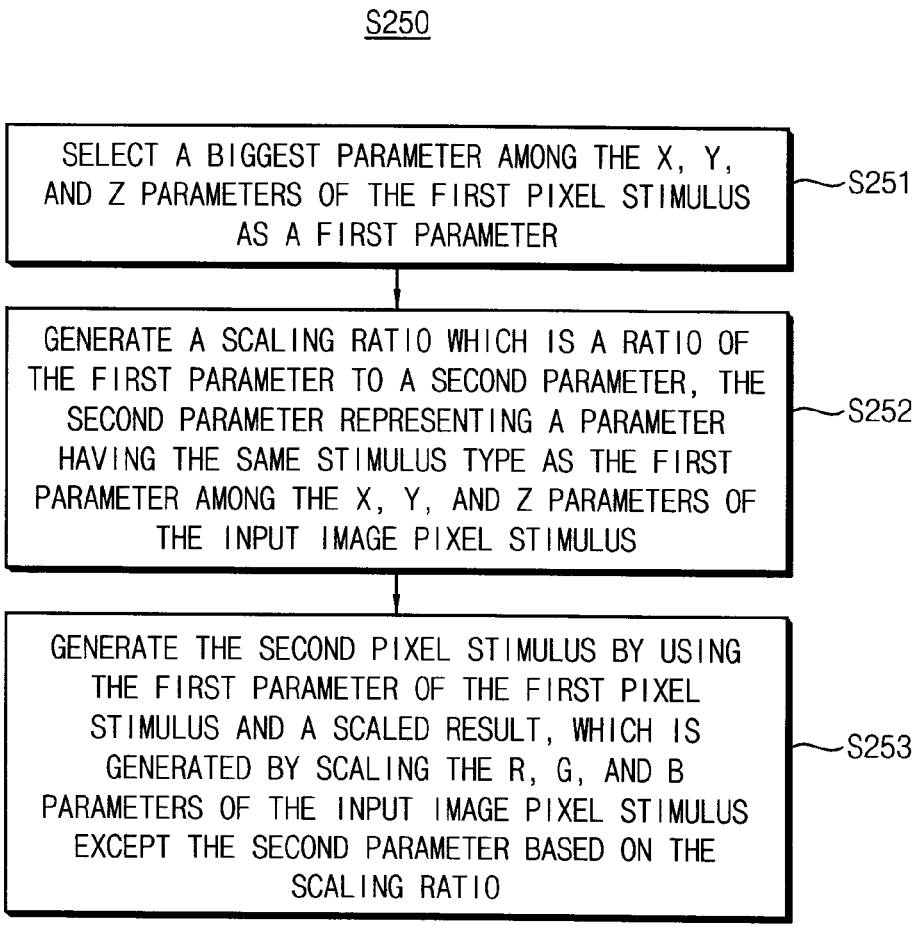
FIG. 8 is a flow chart illustrating generating the second pixel stimulus having the same color as the input image pixel stimulus by scaling the first pixel stimulus included in the flow chart of FIG. 7 according to exemplary embodiments.

FIG. 8 is a flow chart illustrating generating the second pixel stimulus having the same color as the input image pixel stimulus by scaling the first pixel stimulus included in the flow chart of FIG. 7 according to exemplary embodiments.

Referring to FIG. 8, generating the second pixel stimulus having the same color as the input image pixel stimulus by scaling the first pixel stimulus (S250 of FIG. 7) may include selecting a biggest parameter among the X, Y, and Z parameters of the first pixel stimulus as a first parameter (S251), generating a scaling ratio which is a ratio of the first parameter to a second parameter, the second parameter representing a parameter having the same stimulus type as the first parameter among the X, Y, and Z parameters of the input image pixel stimulus (S252), and generating the second pixel stimulus by using the first parameter of the first pixel stimulus and a scaled result, which is generated by scaling X, Y, and Z parameters of the input image pixel stimulus except the second parameter based on the scaling ratio (S253).

Selecting the biggest parameter among the X, Y, and Z parameters of the first pixel stimulus as the first parameter (S251) and generating the scaling ratio (S252) may be understood based on at least references to FIGS. 9C and 10C and will be described with reference thereto. Generating the second pixel stimulus (S253) may be understood based on at least references to FIGS. 9D and 10D and will be described with reference thereto.

FIGS. 9A through 9E are graphs illustrating exemplary embodiments of data of the flow chart of FIG. 7.

Referring to FIGS. 9A through 9E, the X, Y, and Z parameters of the input image pixel stimulus, the external optical stimulus, the first pixel stimulus, the second pixel stimulus, and the output image pixel stimulus of FIGS. 9A through 9E may correspond to the R, G, and B parameters of input image pixel data, the external optical data, the first pixel data, the second pixel data, and the output image pixel data of FIG. 5A through 5E, respectively. FIGS. 9A through 9E may be understood based on at least references to FIGS. 5A through 5E.

Figure 9A:
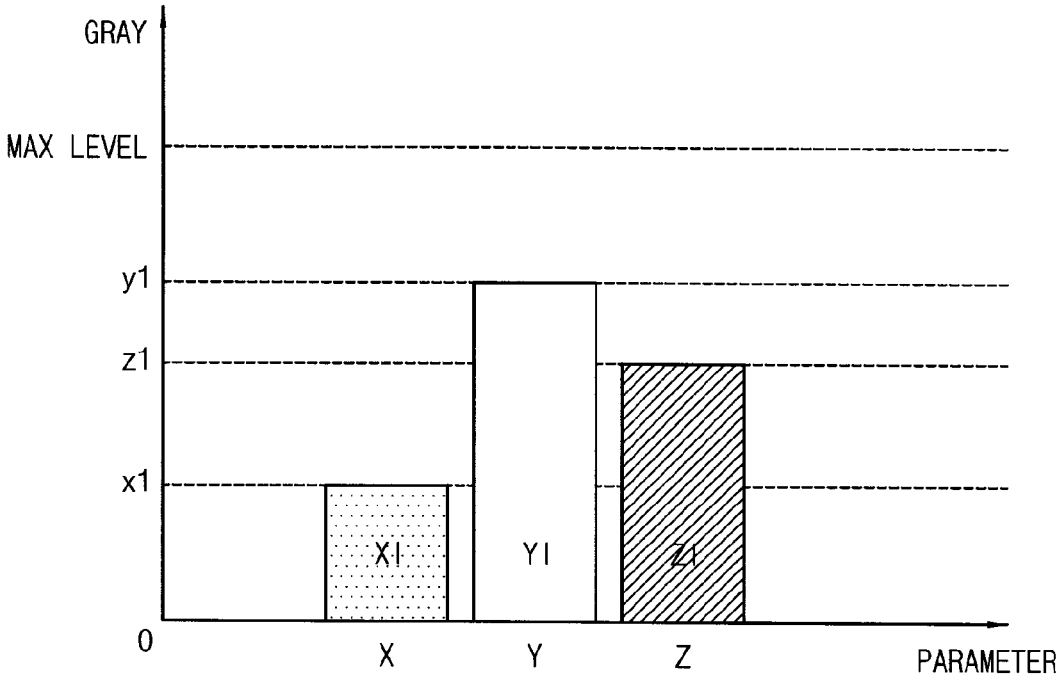
FIGS. 9A through 9E are graphs illustrating exemplary embodiments of data of the flow chart of FIG. 7.

Referring to FIG. 9A, the input image pixel stimulus XI, YI, and ZI includes x1 as the X parameter, includes y1 as the Y parameter, and includes z1 as the Z parameter.

Figure 9B:
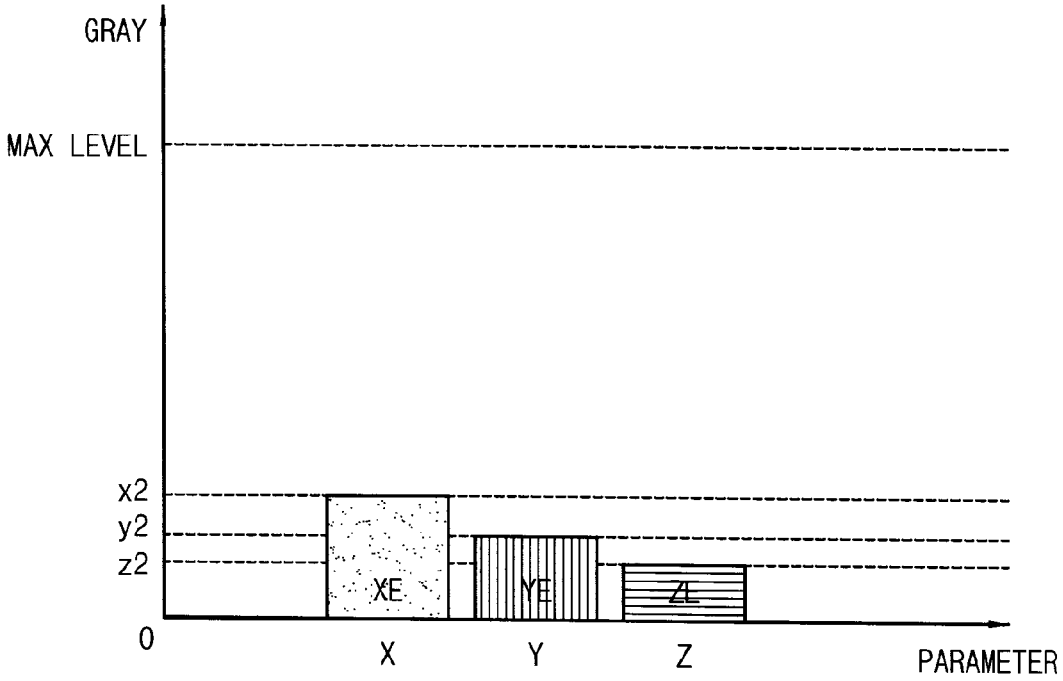

Referring to FIG. 9B, the external optical stimulus XE, YE, and ZE includes x2 as the X parameter, includes y2 as the Y parameter, and includes z2 as the Z parameter. The external optical stimulus XE, YE, and ZE may be measured by optical sensor 270 included in the transparent display device 200 of FIG. 11. The external optical stimulus XE, YE, and ZE may be measured by first optical sensor 371 or second optical sensor 372 included in the transparent display device 300 of FIG. 12.

Figure 9C:
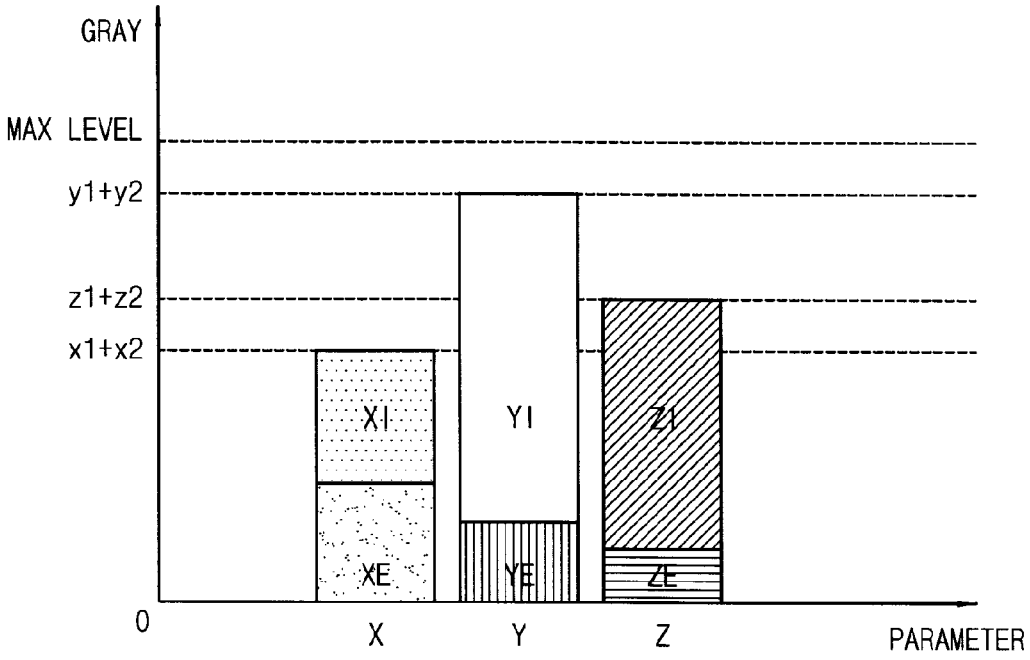

Referring to FIG. 9C, generating the first pixel stimulus by adding the input image pixel stimulus and the external optical stimulus (S240 of FIG. 7) may calculate x1+x2 as the X parameter of the first pixel stimulus by adding x1, the X parameter of the input image pixel stimulus XI, YI, and ZI, and x2, the X parameter of the external optical stimulus XE, YE, and ZE. Generating the first pixel stimulus by adding the input image pixel stimulus and the external optical stimulus (S240) may calculate y1+y2 as the Y parameter of the first pixel stimulus by adding y1, the Y parameter of the input image pixel stimulus XI, YI, and ZI, and y2, the Y parameter of the external optical stimulus XE, YE, and ZE. Generating the first pixel stimulus by adding the input image pixel stimulus and the external optical stimulus (S240) may calculate z1+z2 as the Z parameter of the first pixel stimulus by adding z1, the Z parameter of the input image pixel stimulus XI, YI, and ZI, and z2, the Z parameter of the external optical stimulus XE, YE, and ZE.

Selecting the biggest parameter among the X, Y, and Z parameters of the first pixel stimulus as the first parameter (S251 of FIG. 8) may select the Y parameter of the first pixel stimulus, which has the biggest value, for example, (y1+y2), among the X, Y, and Z parameters of the first pixel stimulus as shown in FIG. 9C, as the first parameter.

Generating the scaling ratio (S252 of FIG. 8) may set the scaling ratio as the ratio of the first parameter to the second parameter, which is, in this example, (y1+y2)/y1, in which y1+y2 is the first parameter and the Y parameter of the first pixel stimulus, and y1 is the second parameter and the Y parameter of the input image pixel stimulus XI, YI, and ZI.

Generating the scaling ratio (S252) may include generating the scaling ratio having a ratio of the first parameter to a limit value of the second parameter when the second parameter has a value equal to the limit value of the second parameter. In FIG. 9C, when the Y parameter of the input image pixel stimulus XI, YI, and ZI (i.e., the second parameter) has a value equal to the limit value MAX LEVEL of the Y parameter of the input image pixel stimulus XI, YI, and ZI, the scaling ratio may be (MAX LEVEL+y2)/MAX LEVEL, which is a ratio of MAX LEVEL+y2, the Y parameter of the first pixel stimulus, to MAX LEVEL, the limit value of the Y parameter of the input image pixel stimulus XI, YI, and ZI.

Figure 9D:
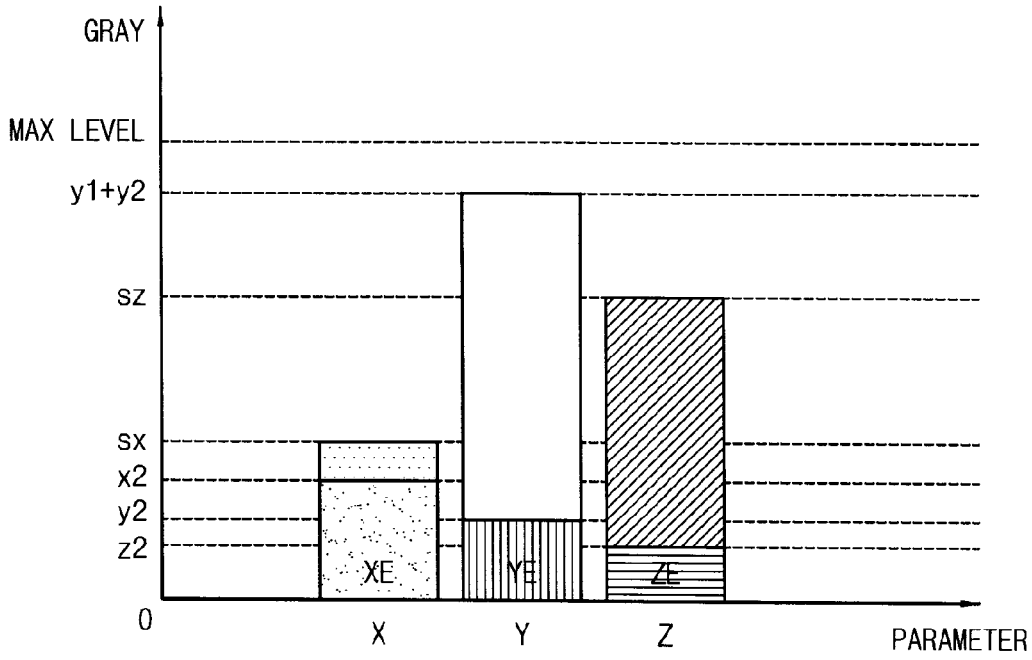

Referring to FIG. 9D, generating the second pixel stimulus by using the first parameter of the first pixel stimulus and the scaled result (S253 of FIG. 2) may set the X parameter of the second pixel stimulus as sx (=x1*(y1+y2)/y1 or x1*(MAX LEVEL+y2)/MAX LEVEL) by scaling the X parameter of the input image pixel stimulus XI, YI, and ZI based on the scaling ratio. Generating the second pixel stimulus by using the first parameter of the first pixel stimulus and the scaled result (S253) may set the Y parameter of the second pixel stimulus as y1+y2, the Y parameter of the first pixel stimulus. Generating the second pixel stimulus by using the first parameter of the first pixel stimulus and the scaled result (S253) may set the Z parameter of the second pixel stimulus as sz (=z1*(y1+y2)/y1 or z1*(MAX LEVEL+y2)/MAX LEVEL) by scaling the Z parameter of the input image pixel stimulus XI, YI, and ZI based on the scaling ratio.

Because a ratio of the X, Y, and Z parameters of the second pixel stimulus is the same as a ratio of the X, Y, and Z parameters of the input image pixel stimulus XI, YI, and ZI, the second pixel stimulus and the input image pixel stimulus XI, YI, and ZI have the same color. Because the X, Y, and Z parameters of the second pixel stimulus are bigger than the X, Y, and Z parameters of the input image pixel stimulus XI, YI, and ZI respectively, a luminance of the second pixel stimulus is bigger than a luminance of the input image pixel stimulus XI, YI, and ZI.

Figure 9E:
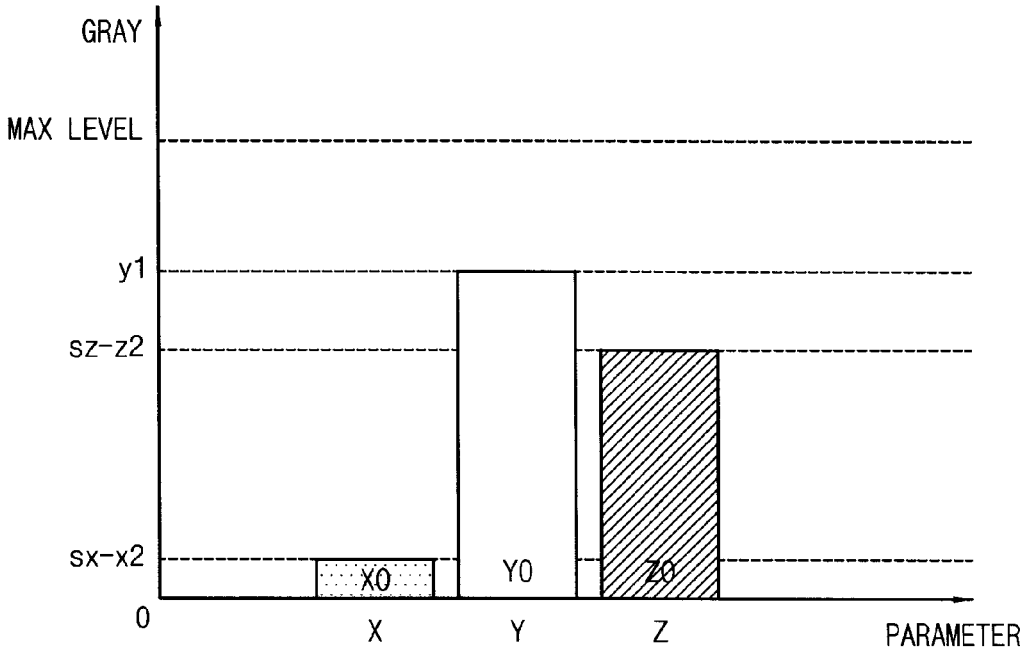

Referring to FIG. 9E, generating the output image pixel stimulus by subtracting the external optical stimulus from the second pixel stimulus (S260 of FIG. 7) may calculate sx-x 2 as XO, the X parameter of the output image pixel stimulus, by subtracting x2, the X parameter of the external optical stimulus XE, YE, and ZE, from sx, the X parameter of the second pixel stimulus. Generating the output image pixel stimulus by subtracting the external optical stimulus from the second pixel stimulus (S260) may calculate y1 as YO, the Y parameter of the output image pixel stimulus, by subtracting y2, the Y parameter of the external optical stimulus XE, YE, and ZE, from y1+y2, the Y parameter of the second pixel stimulus. Generating the output image pixel stimulus by subtracting the external optical stimulus from the second pixel stimulus (S260) may calculate sz-z2 as ZO, the Z parameter of the output image pixel stimulus, by subtracting z2, the Z parameter of the external optical stimulus XE, YE, and ZE, from sz, the Z parameter of the second pixel. The converting the output image pixel stimulus to the output image pixel data (S270) may convert the output image pixel stimulus, including X, Y, and Z parameters as a tri-stimulus, to the output image pixel data, including R, G, and B data, based on an inverse of the transformation matrix corresponding to a GOG (Gain, Offset, and Gamma) function.

FIGS. 10A through 10H are graphs illustrating exemplary embodiments of data of the flow chart of FIG. 7.

FIGS. 10A through 10H may be understood based on at least references to FIGS. 6A through 6H, and FIGS. 9A through 9E.

Figure 10A:
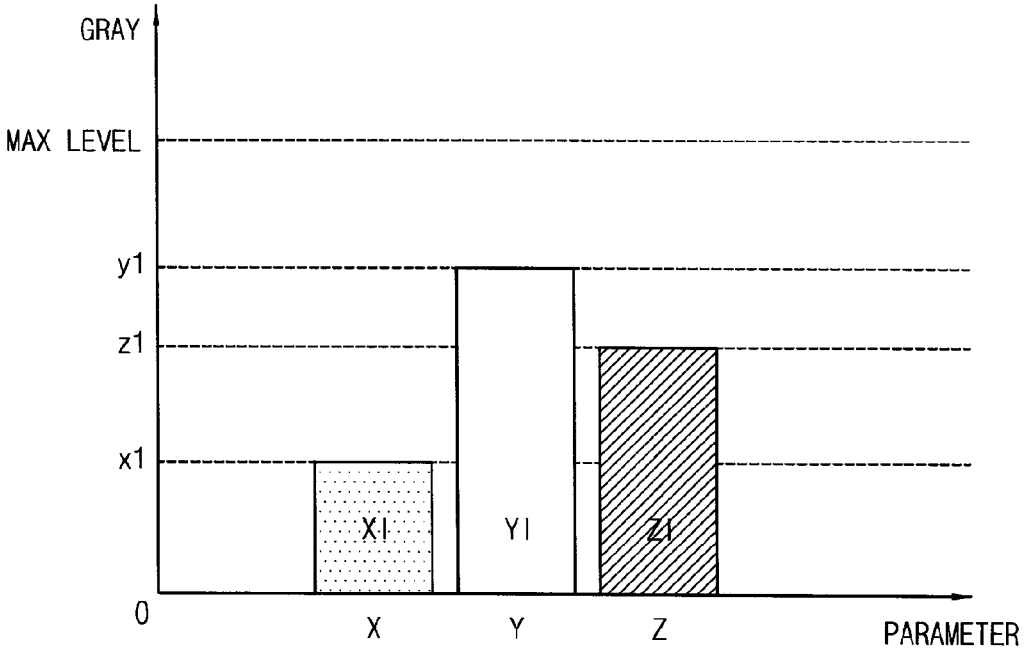
FIGS. 10A through 10H are graphs illustrating exemplary embodiments of data of the flow chart of FIG. 7.

Referring to FIG. 10A, the input image pixel stimulus XI, YI, and ZI includes x1 as the X parameter, includes y1 as the Y parameter, and includes z1 as the Z parameter.

Figure 10B:
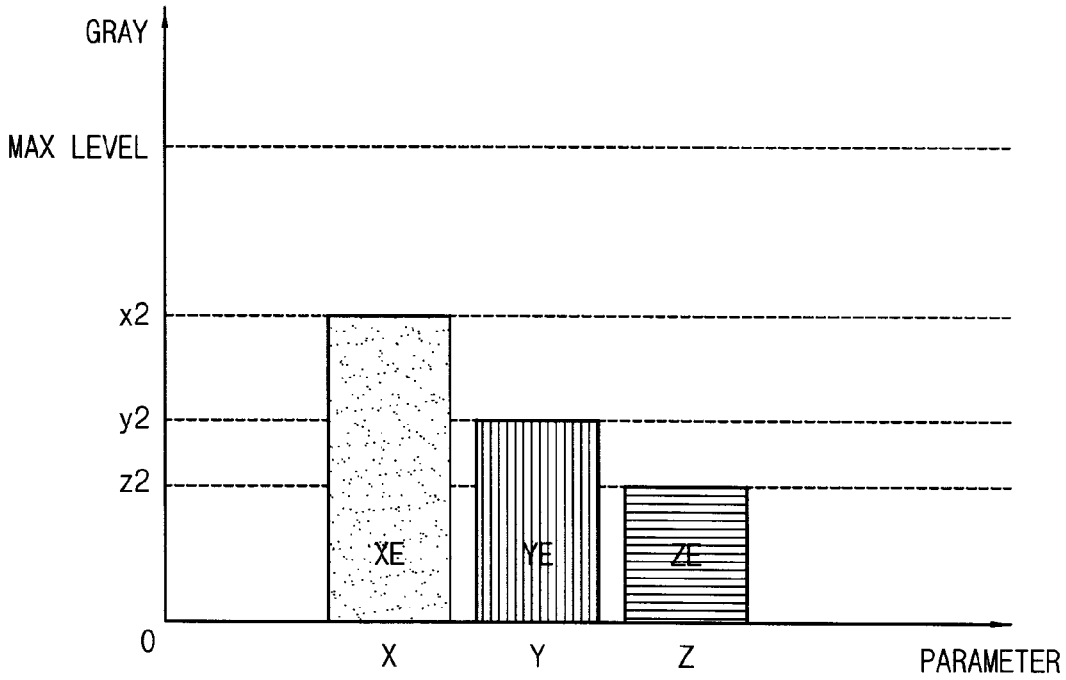

Referring to FIG. 10B, the external optical stimulus XE, YE, and ZE includes x2 as the X parameter, includes y2 as the Y parameter, and includes z2 as the Z parameter. A luminance of the external optical stimulus XE, YE, and ZE of FIG. 10B may be bigger than a luminance of the external optical stimulus XE, YE, and ZE of FIG. 9B. The external optical stimulus XE, YE, and ZE may be measured by optical sensor 270 included in the transparent display device 200 of FIG. 11. The external optical stimulus XE, YE, and ZE may be measured by first optical sensor 371 or second optical sensor 372 included in the transparent display device 300 of FIG. 12.

Figure 10C:
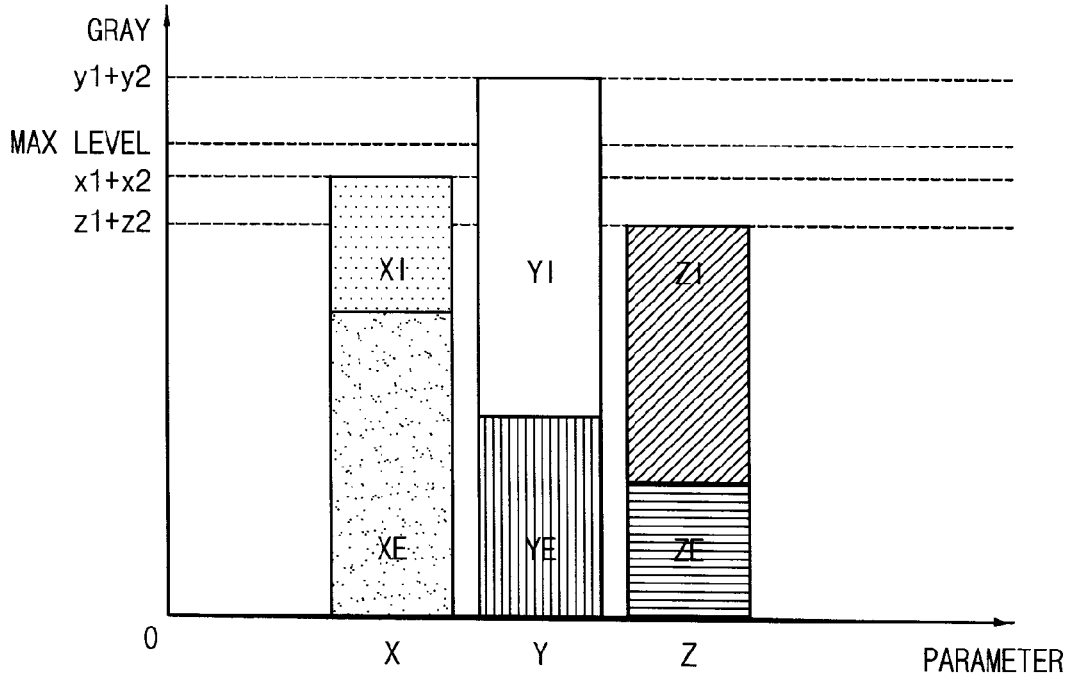

Referring to FIG. 10C, generating the first pixel stimulus by adding the input image pixel stimulus and the external optical stimulus (S240 of FIG. 7) may calculate x1+x2 as the X parameter of the first pixel stimulus by adding x1, the X parameter of the input image pixel stimulus XI, YI, and ZI, and x2, the X parameter of the external optical stimulus XE, YE, and ZE. Generating the first pixel stimulus by adding the input image pixel stimulus and the external optical stimulus (S240) may calculate y1+y2 as the Y parameter of the first pixel stimulus by adding y1, the Y parameter of the input image pixel stimulus XI, YI, and ZI, and y2, the Y parameter of the external optical stimulus XE, YE, and ZE. Generating the first pixel stimulus by adding the input image pixel stimulus and the external optical stimulus (S240) may calculate z1+z2 as the Z parameter of the first pixel stimulus by adding z1, the Z parameter of the input image pixel stimulus XI, YI, and ZI, and z2, the Z parameter of the external optical stimulus XE, YE, and ZE.

Selecting the biggest parameter among the X, Y, and Z parameters of the first pixel stimulus as the first parameter (S251 of FIG. 8) may select the Y parameter of the first pixel stimulus, which has the biggest value (y1+y2) among the X, Y, and Z parameters of the first pixel stimulus, as the first parameter.

Generating the scaling ratio (S252 of FIG. 8) may set the scaling ratio as the ratio of the first parameter to the second parameter, which is, in this example, (y1+y2)/y1, in which y1+y2 is the first parameter and the Y parameter of the first pixel stimulus, and y1 is the second parameter and the Y parameter of the input image pixel stimulus XI, YI, and ZI.

When the Y parameter of the input image pixel stimulus XI, YI, and ZI (the second parameter) has a value equal to the limit value MAX LEVEL of the Y parameter of the input image pixel stimulus XI, YI, and ZI, generating the scaling ratio (S252 of FIG. 8) may set the scaling ratio as (MAX LEVEL+y2)/MAX LEVEL, which is a ratio of MAX LEVEL+y2, the Y parameter of the first pixel stimulus, to MAX LEVEL, the limit value of the Y parameter of the input image pixel stimulus XI, YI, and ZI.

Figure 10D:
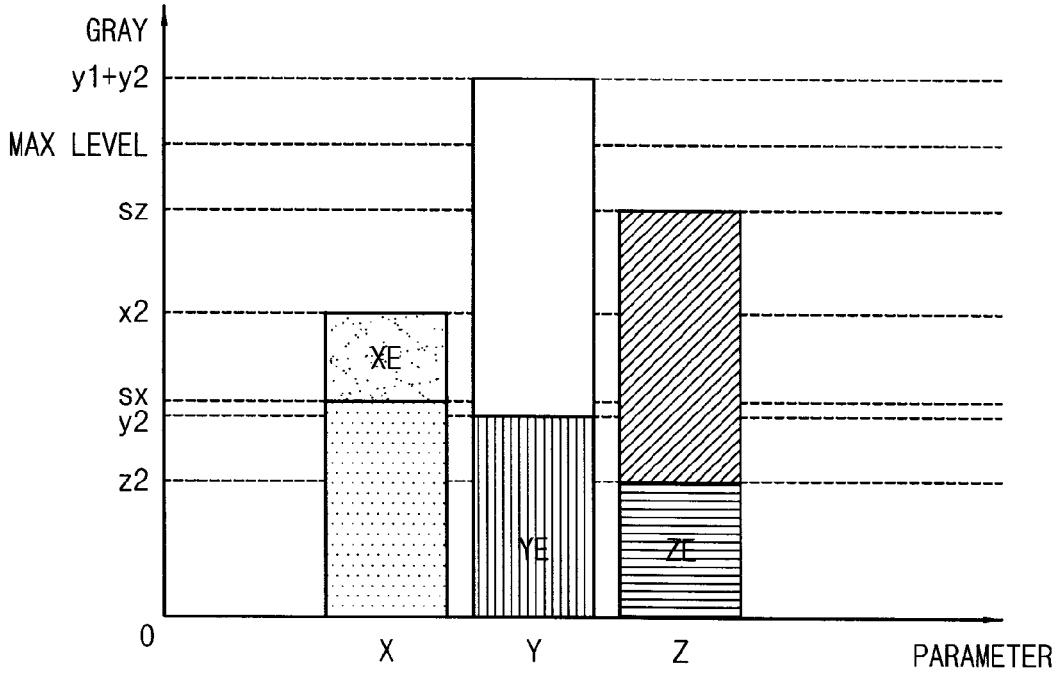

Referring to FIG. 10D, generating the second pixel stimulus by using the first parameter of the first pixel stimulus and the scaled result (S253 of FIG. 8) may set the X parameter of the second pixel stimulus as sx (=x1*(y1+y2)/y1 or x1*(MAX LEVEL+y2)/MAX LEVEL) by scaling the X parameter of the input image pixel stimulus XI, YI, and ZI based on the scaling ratio. As shown in FIG. 10D, the scaled second pixel stimulus sx for the X parameter is less than the X parameter of the external optical stimulus XE, YE, and ZE. Generating the second pixel stimulus by using the first parameter of the first pixel stimulus and the scaled result (S253) may set the Y parameter of the second pixel stimulus as y1+y2, the Y parameter of the first pixel stimulus. Generating the second pixel stimulus by using the first parameter of the first pixel stimulus and the scaled result (S253) may set the Z parameter of the second pixel stimulus as sz (=z1*(y1+y2)/y1 or z1*(MAX LEVEL+y2)/MAX LEVEL) by scaling the Z parameter of the input image pixel stimulus XI, YI, and ZI based on the scaling ratio.

Because a ratio of the X, Y, and Z parameters of the second pixel stimulus is the same as a ratio of the X, Y, and Z parameters of the input image pixel stimulus XI, YI, and ZI, the second pixel stimulus and the input image pixel stimulus XI, YI, and ZI have the same color. Because the X, Y, and Z parameters of the second pixel stimulus are bigger than the X, Y, and Z parameters of the input image pixel stimulus XI, YI, and ZI respectively, a luminance of the second pixel stimulus is bigger than a luminance of the input image pixel stimulus XI, YI, and ZI.

Figure 10E:
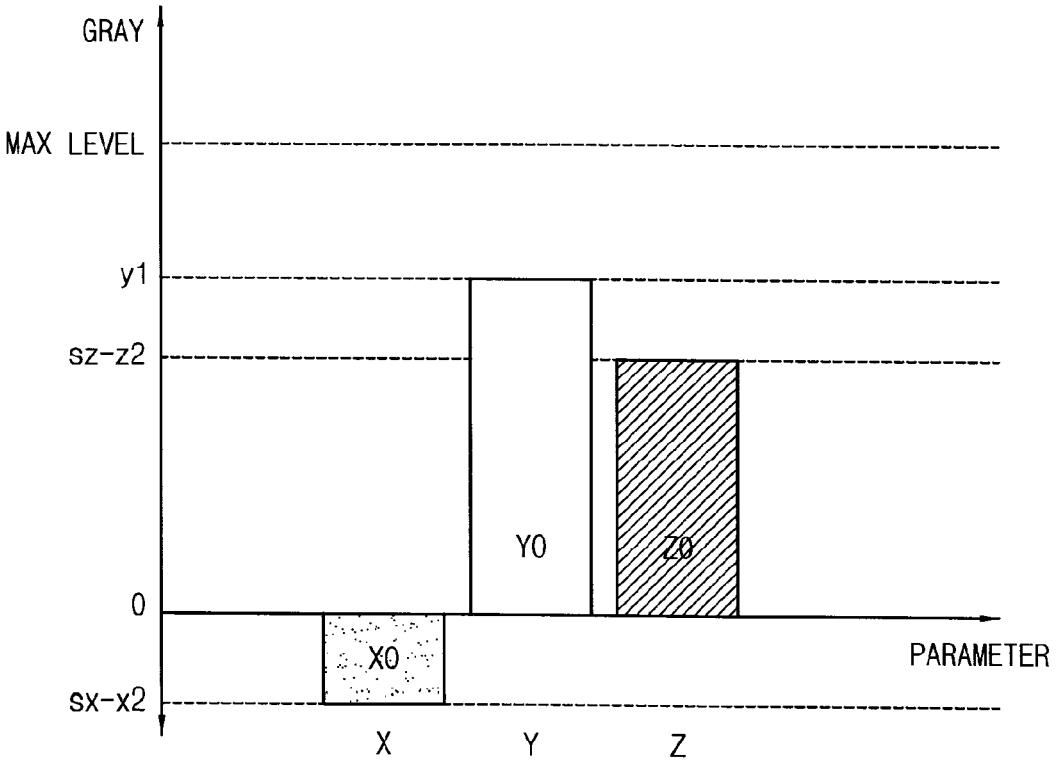

Referring to FIG. 10E, generating the output image pixel stimulus by subtracting the external optical stimulus from the second pixel stimulus (S260 of FIG. 7) may calculate sx-x 2 as XO, the X parameter of the output image pixel stimulus, by subtracting x2, the X parameter of the external optical stimulus XE, YE, and ZE, from sx, the X parameter of the second pixel stimulus. Generating the output image pixel stimulus by subtracting the external optical stimulus from the second pixel stimulus (S160) may calculate y1 as YO, the Y parameter of the output image pixel stimulus, by subtracting y2, the Y parameter of the external optical stimulus XE, YE, and ZE, from y1+y2, the Y parameter of the second pixel stimulus. Generating the output image pixel stimulus by subtracting the external optical stimulus from the second pixel stimulus (S260) may calculate sz-z2 as ZO, the Z parameter of the output image pixel stimulus, by subtracting z2, the Z parameter of the external optical stimulus XE, YE, and ZE, from sz, the Z parameter of the second pixel stimulus.

According to exemplary embodiments, generating the output image pixel stimulus by subtracting the external optical stimulus from the second pixel stimulus (S260 in FIG. 7) may include a generating the output image pixel stimulus to be the same as the input image pixel stimulus when at least one parameter among the X, Y, and Z parameters of the output image pixel stimulus has a negative value. In FIG. 10E, the X parameter of the second pixel stimulus has a negative value, sx-x2. In this case, the output image pixel stimulus may be compensated to be the input image pixel stimulus XI, YI, and ZI.

According to exemplary embodiments, generating the output image pixel stimulus by subtracting the external optical stimulus from the second pixel stimulus (S260 in FIG. 7) may include a compensating the output image pixel stimulus by an inverse and add method when at least one parameter among the X, Y, and Z parameters of the output image pixel stimulus has a negative value. The inverse and add method scales the parameters of the output image pixel that the at least one parameter has 0 and the color of the output image pixel stimulus is maintained. Compensating the output image pixel stimulus by the inverse and add method will be described with the references to FIGS. 10F through 10H.

Figure 10F:
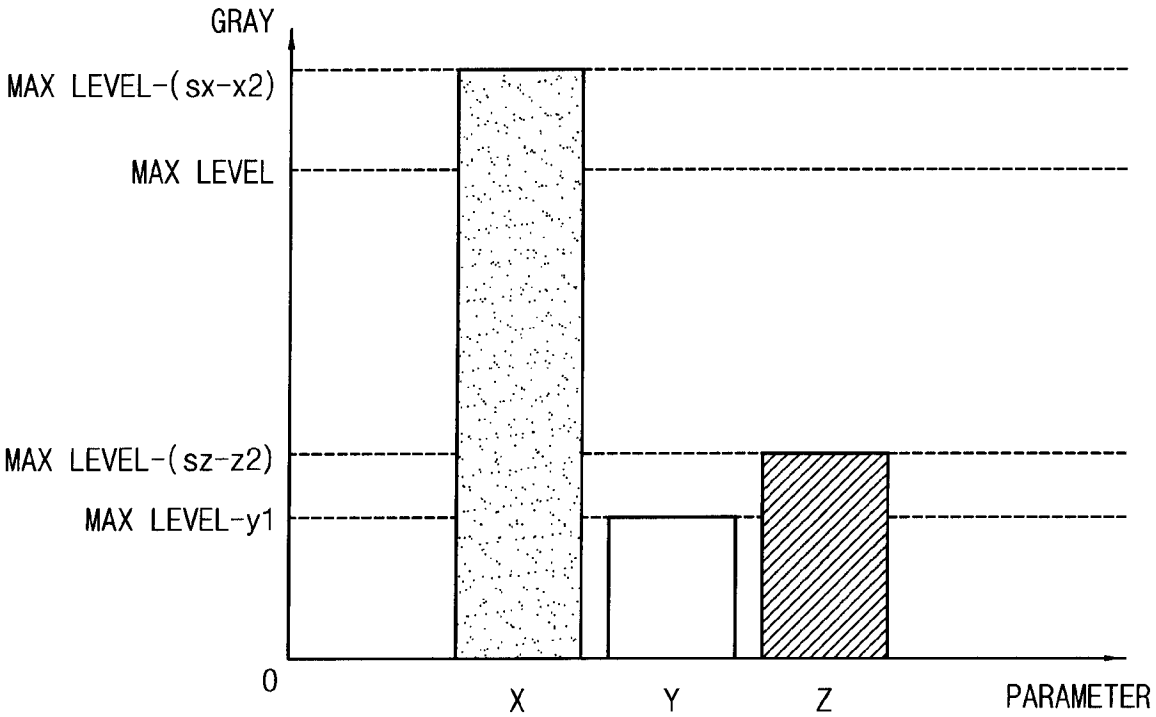

FIG. 10F illustrates a case that the X parameter of the output image pixel stimulus has a negative value. First output image pixel stimulus is generated by subtracting the parameters of the output image pixel stimulus as shown in FIG. 10E from the limit value MAX LEVEL of the parameters of the output image pixel stimulus. The first output image pixel stimulus has MAX LEVEL−(sx−x2) as the X parameter, MAX LEVEL−y1 as the Y parameter, and MAX LEVEL−(sz−z2) as the Z parameter. C(=MAX LEVEL/(MAX LEVEL−(sx−x2)) is a ratio of MAX LEVEL, the limit value of the parameters of the first output image pixel stimulus, to MAX LEVEL−(sx−x2), the X parameter which has a largest value among the X, Y, and Z parameters of the first output image pixel stimulus. Here, the X parameter is selected or determined as having the largest value among the X, Y, and Z parameters of the first output image pixel stimulus; however, aspects need not be limited thereto such that the Y and Z parameters may be selected or determined according circumstances.

Figure 10G:
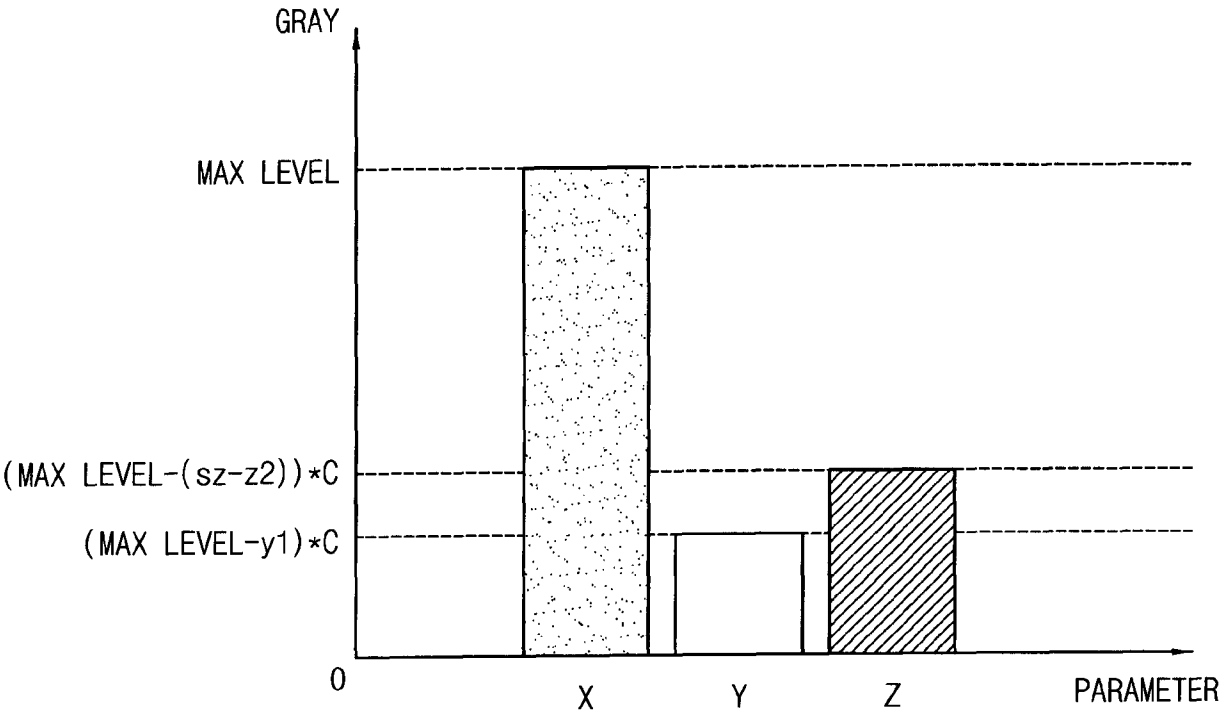

Referring to FIG. 10G, a second output image pixel stimulus is generated by scaling the first output image pixel stimulus based on the C. The second output image pixel stimulus has MAX LEVEL as the X parameter, (MAX LEVEL−y1)*C as the Y parameter, and (MAX LEVEL−(sz−z2))*C as the Z parameter.

Figure 10H:
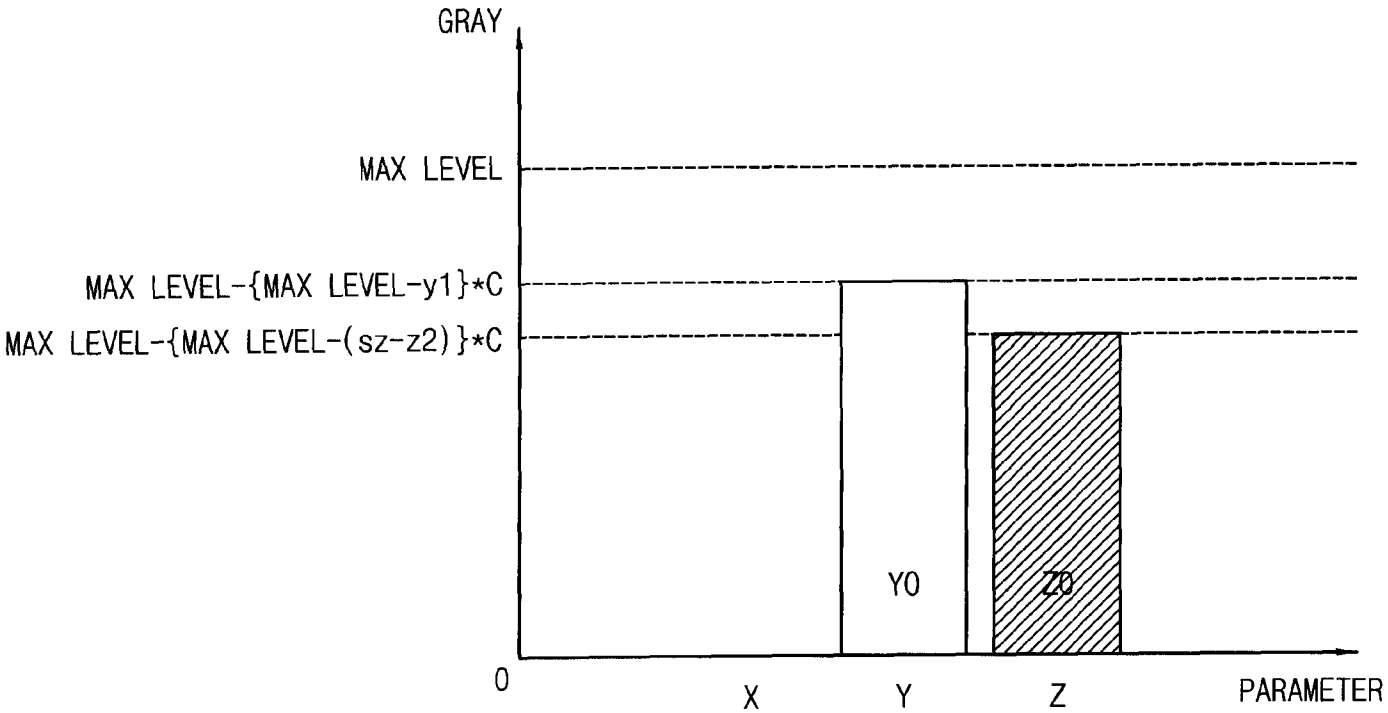

Referring to FIG. 10H, a third output image pixel stimulus is generated by subtracting the second output image pixel stimulus from the limit value MAX LEVEL of the parameters of the second output image pixel stimulus. The third output image pixel stimulus has a value of 0 as the X parameter, MAX LEVEL−(MAX LEVEL−y1)*C as the Y parameter, and MAX LEVEL−(MAX LEVEL−(sz−z2))*C as the Z parameter.

Generating the output image pixel stimulus by subtracting the external optical stimulus from the second pixel stimulus (S260) may generate the output image pixel stimulus which has the third output image pixel stimulus. The converting the output image pixel stimulus to the output image pixel data (S270) may convert the output image pixel stimulus, including X, Y, and Z parameters as a tri-stimulus, to the output image pixel data, including R, G, and B data, based on an inverse of the transformation matrix corresponding to a GOG (Gain, Offset, and Gamma) function.

Figure 11:
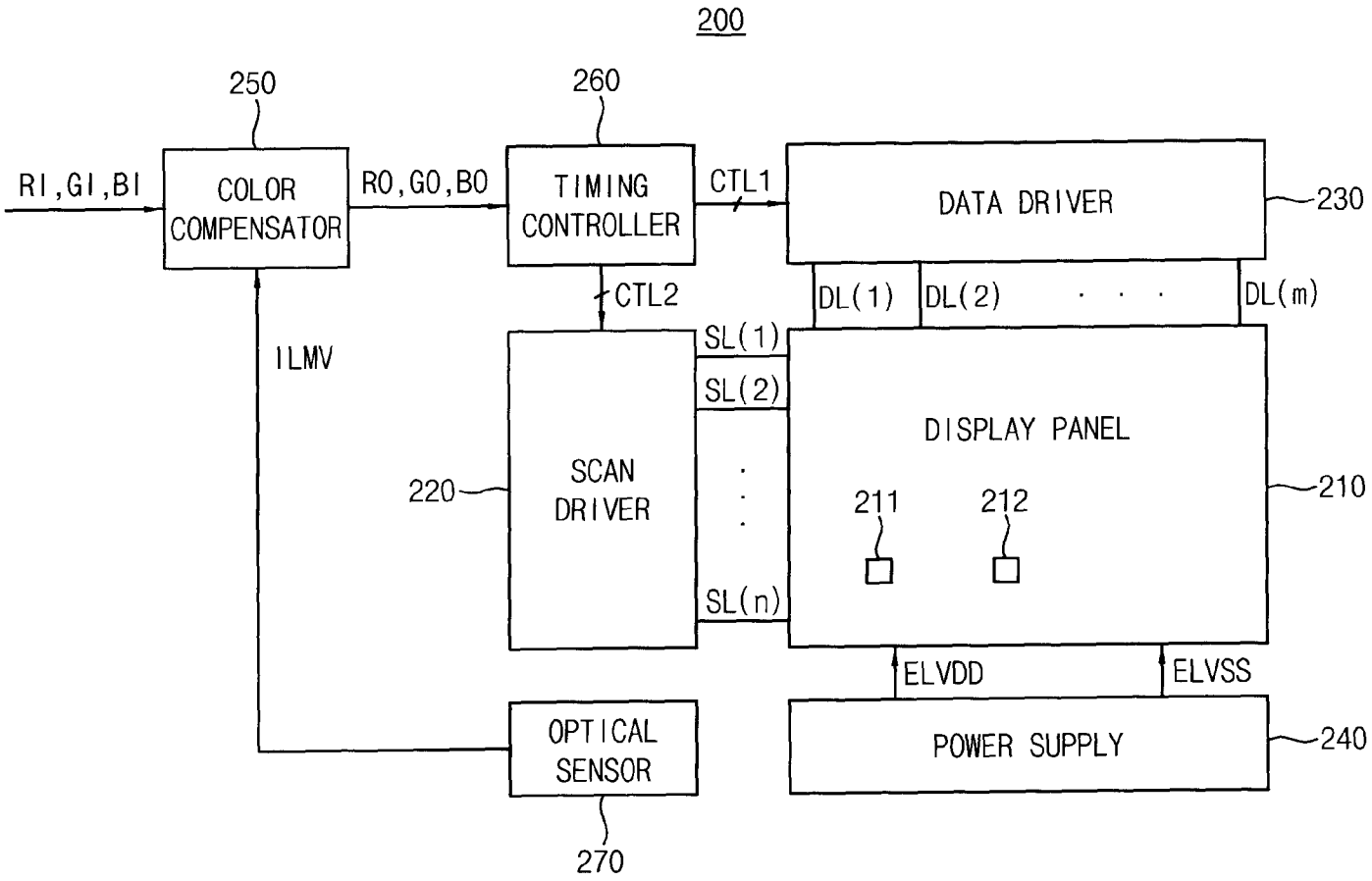
FIG. 11 is a block diagram illustrating a transparent display device according to exemplary embodiments.

FIG. 11 is a block diagram illustrating a transparent display device according to exemplary embodiments.

Referring to FIG. 11, a transparent display device 200 may be an organic light emitting diode (OLED) display device. The transparent display device 200 may include a display panel 210, a scan driver 220, a data driver 230, a power supply 240, a color compensator 250, a timing controller 260, and an optical sensor 270. Light may penetrate the display panel 210 because a substrate of the display panel 210 is transparent and/or thin enough to allow light to pass therethrough.

The display panel 210 may include a plurality of pixels 211, 212. The display panel 210 may be coupled to the scan driver 220 via a plurality of scan lines SL(1) through SL(n), and may be coupled to the data driver 230 via a plurality of data lines DL(1) through DL(m). Here, the pixels 211, 212 may be arranged at locations corresponding to crossing points of the scan lines SL(1) through SL(n) and the data lines DL(1) through DL(m). Thus, the display panel 210 may include n*m pixels. The scan driver 220 may provide a scan signal to the display panel 210 via the scan lines SL(1) through SL(n). The data driver 230 may provide a data signal to the display panel 210 via the data lines DL(1) through DL(m). The power supply 240 may provide a high power voltage ELVDD and a low power voltage ELVSS to the display panel 210. The timing controller 260 may generate a first control signal CTL1 controlling the data driver 230 and a second control signal CTL2 controlling the scan driver 220 based on the output image pixel data RO, GO, and BO.

The optical sensor 270 may generate a first external optical data of a first external light which is incident on the first pixel 211, and may generate a second external optical data of a second external light which is incident on the second pixel 212. The first external optical data and the second external optical data may be the same or may be different according to variances in lighting conditions and/or skin tones, for example. According to exemplary embodiments, the optical sensor 270 may be attached to the transparent display device 200. According to exemplary embodiments, the optical sensor 270 may be separated from the transparent display device 200.

The color compensator 250 may compensate the input image pixel data RI, GI, and BI to the output image pixel data RO, GO, and BO based on the first and second external optical data ILMV, and may transfer the output image pixel data RO, GO, and BO to the timing controller 260. Operation of the color compensator 250 may be understood based on the references to FIGS. 1 through 10H.

Figure 12:
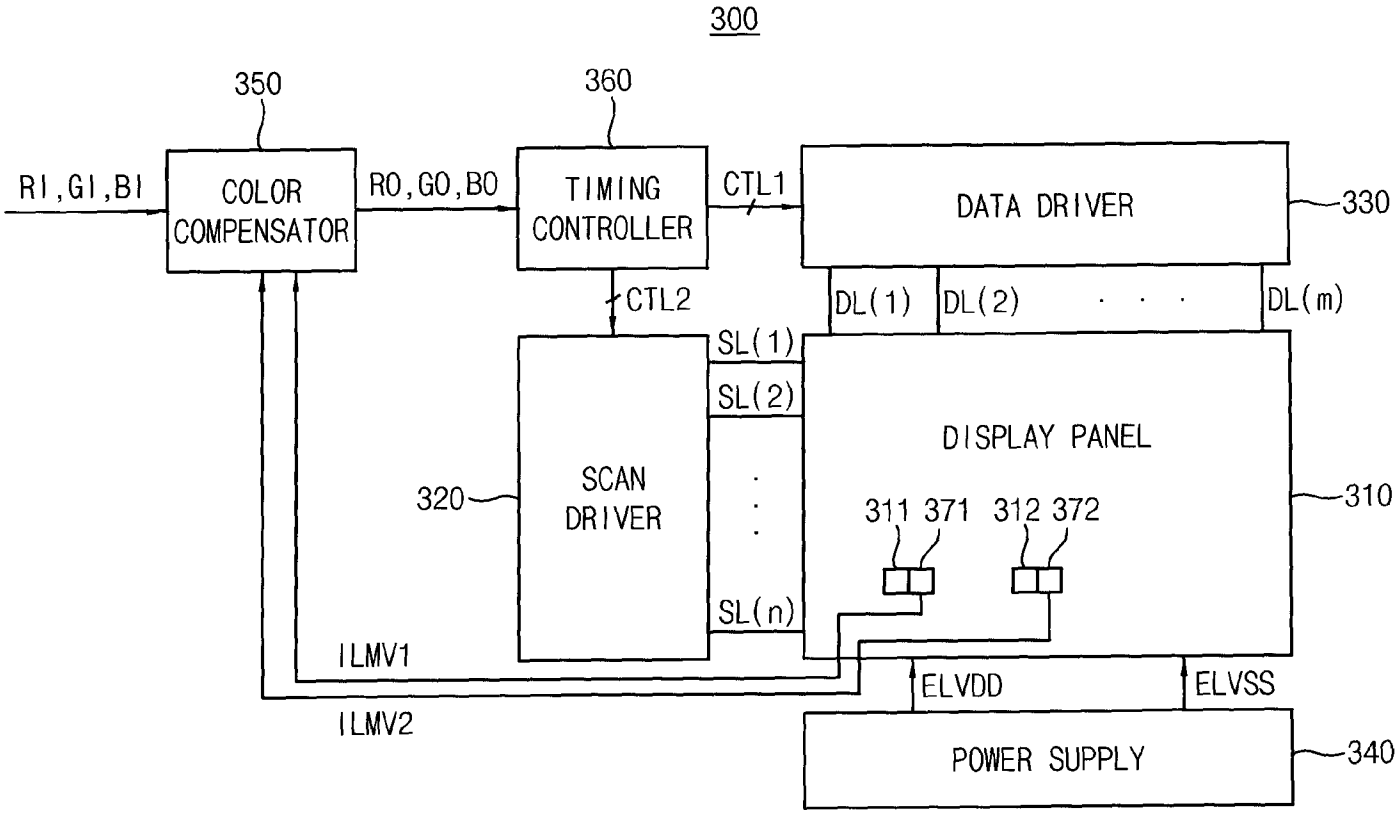
FIG. 12 is a block diagram illustrating a transparent display device according to exemplary embodiments.

FIG. 12 is a block diagram illustrating another transparent display device according to exemplary embodiments.

Referring to FIG. 12, a transparent display device 300 may be an OLED display device. The transparent display device 300 may include a display panel 310, a scan driver 320, a data driver 330, a power supply 340, a color compensator 350, and a timing controller 360. Light may penetrate the display panel 310 because a substrate of the display panel 310 is transparent and/or thin enough to allow light to pass therethrough. The display panel 310 may include a plurality of pixels 311, 312 and a plurality of optical sensors 371, 372.

The display panel 310 may be coupled to the scan driver 320 via a plurality of scan lines SL(1) through SL(n), and may be coupled to the data driver 330 via a plurality of data lines DL(1) through DL(m). Here, the pixels 311, 312 may be arranged at locations corresponding to crossing points of the scan lines SL(1) through SL(n) and the data lines DL(1) through DL(m). Thus, the display panel 310 may include n*m pixels. The scan driver 320 may provide a scan signal to the display panel 310 via the scan lines SL(1) through SL(n). The data driver 330 may provide a data signal to the display panel 310 via the data lines DL(1) through DL(m). The power supply 340 may provide a high power voltage ELVDD and a low power voltage ELVSS to the display panel 310. The timing controller 360 may generate a first control signal CTL1 controlling the data driver 330 and a second control signal CTL2 controlling the scan driver 320 based on the output image pixel data RO, GO, and BO.

The first optical sensor 371 may generate a first external optical data ILMV1 of the first pixel 311. The second optical sensor 372 may generate a second external optical data ILMV2 of the second pixel 312.

The color compensator 350 may compensate the input image pixel data RI, GI, and BI to the output image pixel data RO, GO, and BO based on the first and second external optical data ILMV1, ILMV2, and may transfer the output image pixel data RO, GO, and BO to the timing controller 360. Operation of the color compensator 350 may be understood based on the references to FIGS. 1 through 10H.

Figure 13:
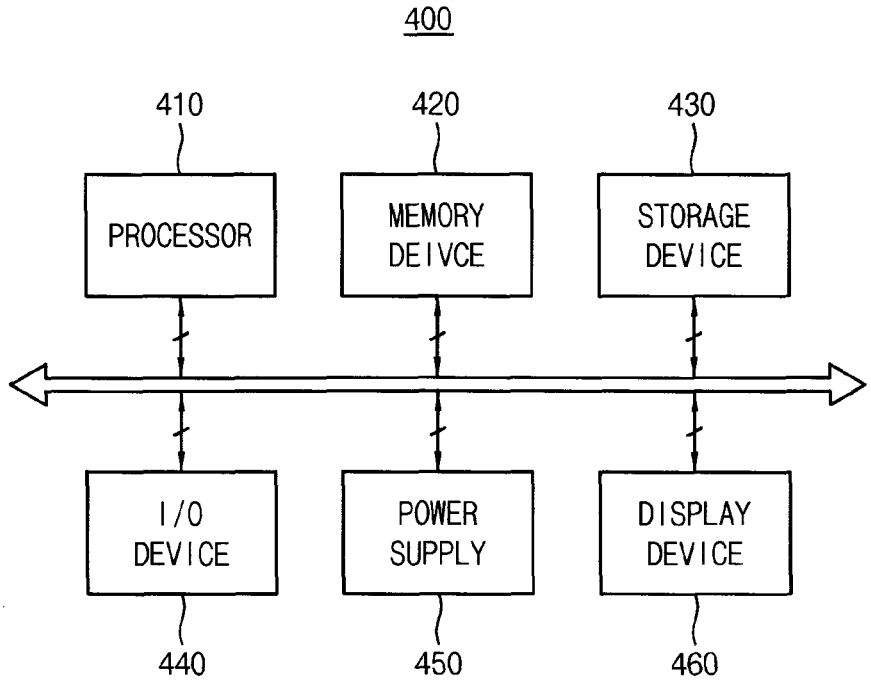
FIG. 13 is a block diagram illustrating an electronic device including a transparent display device according to exemplary embodiments.

FIG. 13 is a block diagram illustrating an electronic device including a transparent display device according to exemplary embodiments.

Referring to FIG. 13, an electronic device 400 may include a processor 410, a memory device 420, a storage device 430, an input/output (I/O) device 440, a power supply 450, and a transparent display device 460. Here, the electronic device 400 may further include a plurality of ports for communicating with a video card, a sound card, a memory card, a universal serial bus (USB) device, other electronic devices, etc. Although the electronic device 400 is implemented as a smart-phone, a kind of the electronic device 400 is not limited thereto.

The processor 410 may perform various computing operations. The processor 410 may be a micro processor, a central processing unit (CPU), etc. The processor 410 may be coupled to other components via an address bus, a control bus, a data bus, etc. Further, the processor 410 may be coupled to an extended bus such as a peripheral component interconnection (PCI) bus.

The memory device 420 may store data for operations of the electronic device 400. For example, the memory device 420 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc.

The storage device 430 may be a solid state drive (SSD) device, a hard disk drive (HDD) device, a CD-ROM device, etc. The I/O device 440 may be an input device such as a keyboard, a keypad, a touchpad, a touch-screen, a mouse, etc, and an output device such as a printer, a speaker, etc. The power supply 450 may provide a power for operations of the electronic device 400. The organic light emitting display device 460 may communicate with other components via the buses or other communication links.

The transparent display device 460 may be the transparent display device 200 of FIG. 11 or the transparent display device 300 of FIG. 12. The transparent display device 460 may be understood based on the references to FIGS. 1 through 12.

The exemplary embodiments may be applied to any electronic system 400 having the transparent display device 460. For example, the present exemplary embodiments may be applied to the electronic system 400, such as a digital or 3D television, a computer monitor, a home appliance, a laptop, a digital camera, a cellular phone, a smart phone, a personal digital assistant (PDA), a portable multimedia player (PMP), a MP3 player, a portable game consol, a navigation system, a video phone, etc.

The present invention may be applied to a transparent display device and an electronic device including the same. For example, the invention may be applied to a monitor, a television, a computer, a laptop computer, a digital camera, a mobile phone, a smartphone, a smart pad, a PDA, a PMP, a MP3 player, a navigation system, and camcorder.

Although certain exemplary embodiments and implementations have been described herein, other embodiments and modifications will be apparent from this description.

Accordingly, the inventive concept is not limited to such embodiments, but rather to the broader scope of the presented claims and various obvious modifications and equivalent arrangements.

What is claimed is:

1. A method of compensating color of a transparent display device, the method comprising:

generating first pixel data by adding input image pixel data and external optical data, the external optical data generated by an optical sensor representing an effect of an external light on the transparent display device;

generating second pixel data having the same color as the input image pixel data by scaling the first pixel data; and generating output image pixel data by subtracting the external optical data from the second pixel data, wherein each of the input image pixel data, the external optical data, the first pixel data, the second pixel data, and the output image pixel data comprises an R (Red) parameter, a G (Green) parameter, and a B (Blue) parameter, and wherein generating the second pixel data having the same color as the input image pixel data by scaling the first pixel data comprises:

selecting a biggest parameter among the R, G, and B parameters of the first pixel data as a first parameter;

generating a scaling ratio which is a ratio of the first parameter to a second parameter, the second parameter representing a parameter having the same color as the first parameter among the R, G, and B parameters of the input image pixel data; and generating the second pixel data by using the first parameter of the first pixel data and a scaled result, which is generated by scaling the R, G and B parameters of the input image pixel data except the second parameter based on the scaling ratio.

2. The method of claim 1, wherein the second pixel data has a higher luminance than the input image pixel data.

3. The method of claim 1, wherein generating the first pixel data by adding the input image pixel data and the external optical data comprises:

generating the R, G, and B parameters of the first pixel data by adding the R, G, and B parameters of the input image pixel data and the R, G, and B parameters of the external optical data, respectively.

4. The method of claim 2, wherein generating the output image pixel data by subtracting the external optical data from the second pixel data comprises:

generating the R, G, and B parameters of the output image pixel data by subtracting the R, G, and B parameters of the external optical data from the R, G, and B parameters of the second pixel data, respectively.

5. The method of claim 1, wherein generating the scaling ratio comprises:

generating the scaling ratio having a ratio of the first parameter to a limit value of the second parameter when the second parameter has a value equal to the limit value of the second parameter.

6. The method of claim 1, wherein generating the output image pixel data by subtracting the external optical data from the second pixel data comprises:

generating the output image pixel data to be the same as the input image pixel data when at least one parameter among the R, G, and B parameters of the output image pixel data has a negative value.

7. The method of claim 1, wherein generating the output image pixel data by subtracting the external optical data from the second pixel data comprises:

compensating the output image pixel data by an inverse and add method when at least one parameter among the R, G, and B parameters of the output image pixel data has a negative value, the inverse and add method comprising scaling the parameters of the output image pixel such that the at least one parameter has a value of 0 and, the color of the output image pixel data is maintained.

8. The method of claim 1 further comprising:

measuring, by the optical sensor, a first stimulus of the external light which is incident on the transparent display device;

a generating a second stimulus by adding a third stimulus of an external light penetrating the transparent display device and a fourth stimulus of an external light reflected from the transparent display device based on the first stimulus, a transmittance of the transparent display device, and a reflectivity of the transparent display device; and converting the second stimulus to the external optical data based on a transformation matrix.

9. The method of claim 8, wherein the transparent display device comprises a first pixel and a second pixel, and the optical sensor generates a first external optical data of the first pixel and a second external optical data of the second pixel.

10. The method of claim 9, wherein the first external optical data is the same as the second external optical data.

11. The method of claim 8, wherein the transparent display device comprises a first pixel and a second pixel, the optical sensor comprises a first optical sensor and a second optical sensor, the first optical sensor generates a first external optical data of the first pixel, and the second optical sensor generates a second external optical data of the second pixel.

12. The method of claim 8, wherein the optical sensor is attached to the transparent display device.

13. The method of claim 8, wherein the optical sensor is separate from the transparent display device.

14. The method of claim 1, wherein the output image pixel data is provided to a pixel included in the transparent display device.

15. A method of compensating color of a transparent display device, the method comprising:

generating a first pixel stimulus by adding an input image pixel stimulus and an external optical stimulus, the external optical stimulus generated by an optical sensor representing an effect of an external light on the transparent display device;

generating a second pixel stimulus having the same color as the input image pixel stimulus by scaling the first pixel stimulus; and generating an output image pixel stimulus by subtracting the external optical stimulus from the second pixel stimulus, wherein each of the input image pixel stimulus, the external optical stimulus, the first pixel stimulus, the second pixel stimulus, and the output image pixel stimulus comprises an X parameter, a Y parameter, and a Z parameter, and wherein generating the second pixel stimulus having the same color as the input image pixel stimulus by scaling the first pixel stimulus comprises:

selecting a biggest parameter among the X, Y, and Z parameters of the first pixel stimulus as a first parameter;

generating a scaling ratio which is a ratio of the first parameter to a second parameter, the second parameter representing a parameter having the same stimulus type as the first parameter among the X, Y, and Z parameters of the input image pixel stimulus; and generating the second pixel stimulus by using the first parameter of the first pixel stimulus and a scaled result, which is generated by scaling X, Y and Z parameters of the input image pixel stimulus except the second parameter based on the scaling ratio.

16. The method of claim 15 further comprising:

converting an input image pixel data to the input image pixel stimulus based on a transformation matrix;

measuring, by the optical sensor, a first stimulus of the external light which is incident on the transparent display device; and generating the external optical stimulus by adding a second stimulus of an external light penetrating the transparent display device and a third stimulus of an external light reflected from the transparent display device based on the first stimulus, a transmittance of the transparent display device, and a reflectivity of the transparent display device.

17. The method of claim 16 further comprising:

a converting the output image pixel stimulus to an output image pixel data based on an inverse matrix of the transformation matrix.

* * * * *